US005164783A

United States Patent [19]

Taguchi et al.

[11] Patent Number: 5,164,783

[45] Date of Patent: Nov. 17, 1992

[54] IMAGE FORMING APPARATUS FOR THE SYNCHRONIZING OF LASER WRITER WITH PHOTOSENSITIVE BODY TO PREVENT TIME LAG

[75] Inventors: Kazushige Taguchi, Warabi; Hideya Furuta, Yokohama, both of Japan

[73] Assignee: Ricoh Company, Ltd., Tokyo, Japan

[21] Appl. No.: 561,620

[22] Filed: Aug. 1, 1990

[30] Foreign Application Priority Data

| | | | |
|---|---|---|---|
| Aug. 2, 1989 | [JP] | Japan | 1-199372 |
| Aug. 2, 1989 | [JP] | Japan | 1-199374 |
| Aug. 29, 1989 | [JP] | Japan | 1-220251 |
| Jun. 29, 1990 | [JP] | Japan | 2-169964 |

[51] Int. Cl.[5] ..... G03G 15/01

[52] U.S. Cl. ..... 355/327; 346/108; 346/160; 355/204; 355/208; 355/271

[58] Field of Search ..... 355/208, 326, 327, 328, 355/204, 271; 430/42, 44; 346/134, 136, 139 A, 108, 160; 358/108, 300

[56] References Cited

U.S. PATENT DOCUMENTS

| | | | |
|---|---|---|---|
| 4,819,025 | 4/1989 | Takahashi et al. | 355/527 X |
| 4,847,660 | 7/1989 | Wheatley, Jr. et al. | 355/244 |
| 4,908,675 | 3/1990 | Suzuki | 355/327 X |
| 4,947,209 | 8/1990 | Maeno et al. | 355/204 |
| 4,959,669 | 9/1990 | Heneda et al. | 355/326 X |
| 4,975,741 | 12/1990 | Tanaka | 355/208 X |
| 5,023,708 | 6/1991 | Maruyama et al. | 355/327 X |

FOREIGN PATENT DOCUMENTS 63-70265 3/1988 Japan .

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

An image forming apparatus has a device for sequentially forming a plurality of images by repeatedly performing an optical writing operation a plurality of times on a photosensitive body face every predetermined timing; a device for sequentially overlapping and transferring the images; a detector for detecting a timing shift from a time point of a command for starting the optical writing operation each time to a start time point of the actual writing operation; and a device for correcting the timing shift to overlap and transfer the images.

5 Claims, 23 Drawing Sheets

IMAGE FORMING APPARATUS FOR THE SYNCHRONIZING OF LASER WRITER WITH PHOTOSENSITIVE BODY TO PREVENT TIME LAG

BACKGROUND OF THE INVENTION

1. Field of the Invention

The present invention relates to an image forming apparatus for writing an image in synchronization with a main scanning operation using a laser beam. The present invention also relates to an apparatus for forming an image by correcting a time lag at a writing time of the image. Further, the present invention relates to an image forming apparatus constructed such that no shift in position of images is caused when overlapping and transferring operations with respect to the images are performed.

2. Description of the Related Art

In a normal analog copying machine, an encoder plate is attached to a drive shaft for a photosensitive body and a basic pulse is formed by the encoder plate in accordance with the rotation of the drive shaft for the photosensitive body. This basic pulse is used in a control section to count up a counter having a timer function, thereby performing sequential control of the copying machine.

Such a controller is disclosed in e.g., Japanese Patent Application Laying Open (KOKAI) Nos. 62-242471 and 63-70265. When the above sequential control method of the analog copying machine is applied to a digital copying machine for forming an electrostatic latent image by performing a scanning operation using a laser beam, the following problems are caused.

In the sequential control applied to the above analog copying machine, no used basic pulse is synchronized with a main scanning line of the laser beam. Accordingly, there is a case in which the timing of a writing operation of the image is shifted by one line at its maximum, thereby causing an error in writing operation of the image.

Therefore, when this sequential control system is applied to the digital copying machine for forming an electrostatic latent image by performing a scanning operation using the laser beam, no problems are almost caused in the case of a black-and-white copying machine. However, the above-mentioned error in writing operation of the image causes a shift in color in the case of a color copying machine so that the quality of the image is greatly reduced in a certain case.

It is considered to prevent the shift in color by turning on a gate for starting the writing operation for forming the image by using a detecting signal of the synchronization of the laser beam on the main scanning line. However, in this method, the accuracy in constant rotation of the photosensitive body is reduced so that the shift in color cannot be prevented when the rotation of the photosensitive body is unstable.

To solve this problem, a controller for a copying machine is proposed in Japanese Patent Application Laying Open (KOKAI) No. 63-70265. In this controller, start timings of the photosensitive body and an optical scanning mechanism are synchronized with each other to align images with each other at a transfer time.

However, the structure of such a controller is complicated and manufacturing cost is high.

SUMMARY OF THE INVENTION

It is therefore a first object of the present invention to provide an image forming apparatus in which an image is formed by correcting a time lag at a writing time of the image so that no shift in color is caused even when overlapped images are formed.

A second object of the present invention is to provide an image forming apparatus having a simplified structure and performing overlapping and transferring operations with respect to images with high accuracy.

A third object of the present invention is to provide an image forming apparatus in which a basic pulse for sequential control is formed in synchronization with a main scanning line of a laser beam to perform the sequential control based on this basic pulse so that no shift in color is caused even when overlapped images are formed.

The first object of the present invention can be achieved by an image forming apparatus comprising means for sequentially forming a plurality of images by repeatedly performing an optical writing operation a plurality of times on a photosensitive body face every predetermined timing; means for sequentially overlapping and transferring the images; means for detecting a timing shift from a time point of a command for starting the optical writing operation each time to a start time point of the actual writing operation; and means for correcting the timing shift to overlap and transfer the images.

The first object of the present invention can be also achieved by an image forming apparatus comprising a photosensitive body; drive means for moving the photosensitive body; pulse generating means for generating a pulse output in accordance with a driving speed of the driving means; an optical writing element; means for sequentially exposing optical images corresponding to a plurality of colors on the photosensitive body by a scanning operation using the optical writing element so as to form electrostatic latent images; synchronization signal generating means for generating a main scanning line synchronization signal for the optical writing element; means for developing the latent images; transfer means for sequentially overlapping and transferring the developed images corresponding to the plurality of colors onto a transferred member; conveying drive control means for conveying the transferred member to the transfer means; means for executing an image forming operational sequence by the pulse output of the pulse generating means; and control means for adding the difference in time between a time provided from the pulse generating means at which a writing gate is turned on and the main scanning line synchronization signal as a subsequently outputted signal for starting the actual writing operation to a previous start time of the conveying drive control means for overlapping and transferring the images in a sequential operation, the control means controlling a time point for starting a transfer operation by adding the difference in time to the previous start time.

A shift in color of the images having a plurality of colors is prevented when the images are overlapped and transferred onto the transferred member.

The pulse generating means comprises an encoder disposed in a drive transmission system including a driving shaft for the photosensitive body.

The optical writing operation is repeatedly performed on the photosensitive body face every predetermined timing. The plurality of images are sequentially formed on the photosensitive body face and are sequentially overlapped and transferred onto the transferred member.

In this case, a timing shift from a time point of a command for starting the optical writing operation every time to a time point for starting the actual writing operation is detected and corrected. The images are then overlapped and transferred onto the transferred member.

Optical images corresponding to the plurality of colors are sequentially exposesd on the photosensitive body by the scanning operation using the optical writing element, thereby forming electrostatic latent images. The electrostatic latent images are developed by the developing means. The developed images corresponding to the plurality of colors are sequentially transferred by the transfer means onto a sheet of transfer paper constituting the transferred member.

In this case, the image forming operational sequence is executed by the pulse output of the pulse generating means for generating a pulse corresponding to the driving speed of the driving means for the photosensitive body. The difference in time between a time provided from the pulse generating means at which the write gate is turned on and the main scanning line synchronization signal as a subsequently outputted signal for starting the actual writing operation is added to a start time of the conveying drive control means.

A shift in color of the images having plural colors is prevented by the above control when the images are overlapped and transferred onto the transferred member.

The pulse generating means comprises an encoder disposed in the drive transmission system including a driving shaft for the photosensitive body, thereby executing the above operational sequence.

In accordance with the above-mentioned structure, an image is formed by correcting a time lag at a writing time of the image so that no shift in color is caused even when overlapped images are formed.

The second object of the present invention can be achieved by an image forming apparatus comprising writing means for repeatedly performing an optical writing operation a pluarlity of times on a photosensitive body at a predetermined timing to sequentially form a plurality of images; transfer means for seqentially overlapping and transferring the pluarlity of images onto a transferred member; and means for performing the transfer operation by operating the transfer means using a position as a reference in which a front end of an image written to the photosensitive body by the writing means is moved by a predetermined distance.

The transfer means is operated by using a position as a reference in which a front end of each of images repeatedly written to the photosensitive body a plurality of times by the writing means at a predetermined timing is moved by a predetermined distance, thereby overlapping and transferring the plurality of images.

Accordingly, it is not necessary to synchronize start timings of the photosensitive body and an optical scanning mechanism with each other. Therefore, the image forming apparatus has a simplified structure and the overlapping and transferring operations are performed at any time with high accuracy even when a moving speed of the photosensitive body is changed.

The third object of the present invention can be achieved by an image forming apparatus comprising charging means for charging a photosensitive body; electrostatic latent image forming means for sequentially exposing a plurality of optical images by performing a scanning operation using a laser beam and forming an electrostatic latent image on the photosensitive body; main scanning line synchronization detecting means for detecting synchronization of the laser beam on a main scanning line; developing means for developing the electrostatic latent image; transfer means for sequentially overlapping and transferring the developed image onto a transferred member; and means for setting an output pulse of the main scanning line synchronization detecting means to a basic pulse for a timing of a sequential operation for forming the image.

The transfer means comprises a belt for conveying a sheet of transfer paper and the developed image is sequentially overlapped and transferred onto the sheet of transfer paper by switching the transfer paper conveying belt back.

The photosensitive body comprises a photosensitive body belt. A writing timing for forming a plurality of electrostatic latent images is set in synchronization with a main scanning line synchronization signal approximately every multiple of a counting value of a main scanning line synchronization detecting signal for a time corresponding to one rotation of a drive roller for the photosensitive body belt.

The photosensitive body is charged by the charging means. The photosensitive body charged by the electrostatic latent image forming means is scanned by the laser beam. The plurality of optical images are sequentially exposed and the electrostatic latent image is formed on the photosensitive body. This electrostatic latent image is developed by the developing means and a developed image is thus formed on the photosensitive body.

The synchronization of the laser beam on the main scanning line is detected by the main scanning line synchronization detecting means. The sequential operation for forming the image is performed by the transfer means for sequentially overlapping and transferring the developed image on a sheet of transfer paper on the basis of the output pulse of the main scanning line synchronization detecting means.

The transfer means composed of the transfer paper conveying belt performs a switching-back channel operation. The writing timing for forming a plurality of electrostatic latent images is set in synchronization with the main scanning line synchronization signal approximately every multiple of a counting value of the main scanning line synchronization detecting signal for a time corresponding to one rotation of the drive roller for the photosensitive body composed of the photosensitive body belt.

In accordance with the above-mentioned structure, a basic pulse for the sequential control is formed in synchronization with the main scanning line of the laser beam to perform the sequential control based on this basic pulse so that no shift in color is caused even when overlapped images are formed.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of an image forming apparatus in the present invention will next be described in detail with reference to the accompanying drawings.

Figure 1:
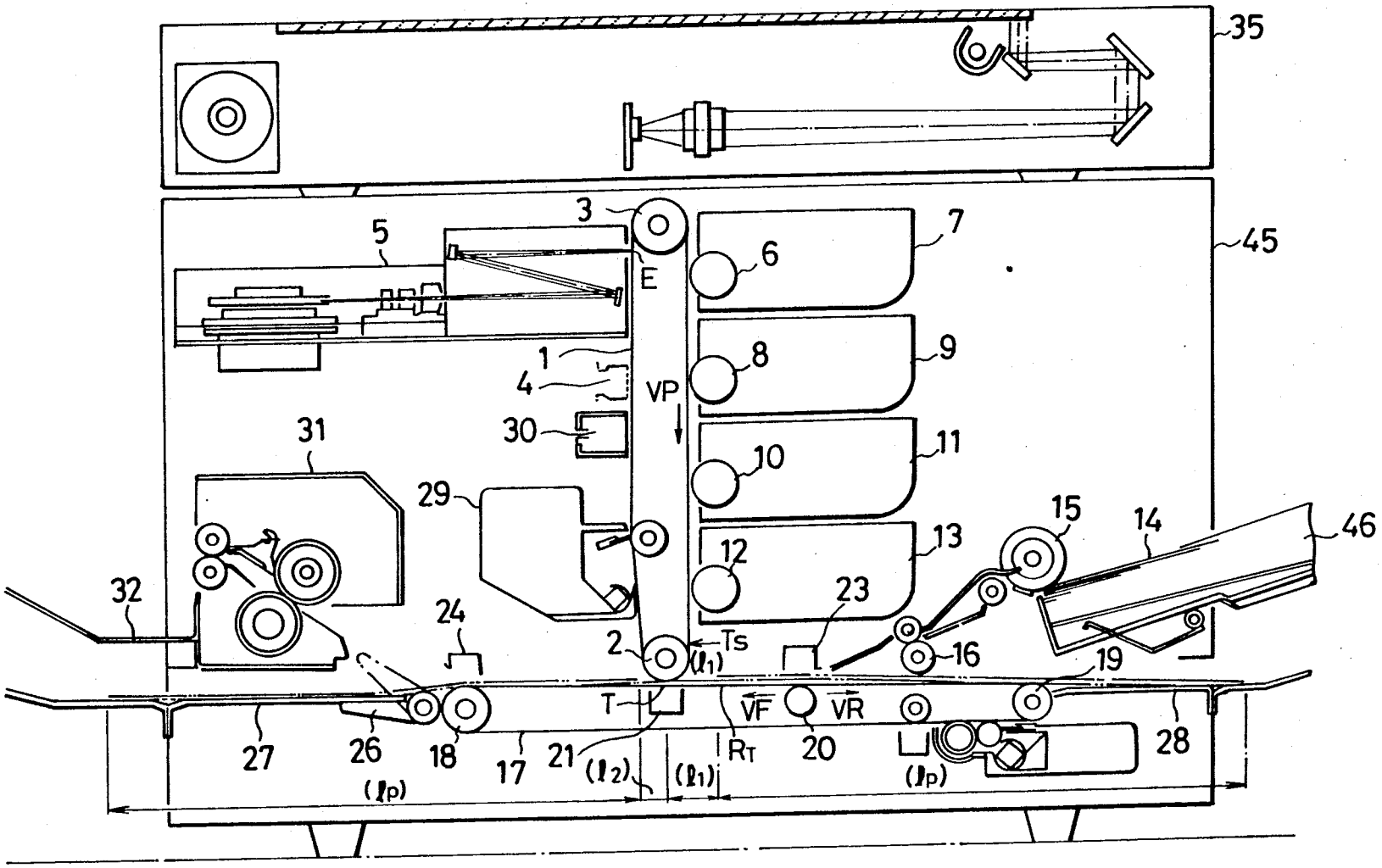
FIG. 1 is a view showing the construction of an image forming apparatus in a first embodiment of the present invention.

FIG. 1 is a view showing the construction of an image forming apparatus in a first embodiment of the present invention. This image forming apparatus has a device 35 for reading a color image, a device 5 for performing an optical writing operation, a photosensitive body belt 1, developing containers 7, 9, 11, 13, a fixing device 31, a transfer belt 17, a tray 46 for receiving a sheet of transfer paper, and a paper discharging tray 32.

An image forming section 45 is disposed within a casing of the image forming apparatus. The device 35 for reading a color image is disposed above this image forming seciton 45.

As shown in FIG. 1, the transfer belt 17 is disposed below the casing of the image forming apparatus and is wound around a drive roller 18 and a driven roller 19. A guide plate 28 is disposed in proximity to the driven roller 19 and a guide plate 27 is disposed in proximity to the drive roller 18. A switching member 26 is disposed between the guide plate 27 and the drive roller 18.

A photosensitive body belt 1 is disposed in a central portion of the casing of the image forming apparatus in a direction perpendicular to the transfer belt 17. The photosensitive body belt 1 is wound around a drive roller 2 and a driven roller 3. A transfer corona portion 21 is disposed in a position opposite to the drive roller 2 through the transfer belt 17.

The transfer paper tray 46 is attached to the casing of the image forming apparatus above the guide plate 28 and is disposed in proximity to this guide plate 28. Sheets of transfer paper 14 are stacked on the transfer paper tray 46. A paper supplying roller 15 is disposed in proximity to a paper supplying port of the transfer paper tray 46. The paper is further fed by the roller 16. An adsorbing charger 23 is opposed to the transfer belt 17 near the drive roller 2 and is disposed in proximity to the transfer belt 17. A contact/separation switching roller 20 is disposed in a position opposite to the adsorbing charger 23 through the transfer belt 17.

A fixing device 31 is disposed above the guide plate 27 and is disposed in proximity to this guide plate 27. The paper discharging tray 32 is connected to this fixing device 31 and is guided to the exterior of the casing of the image forming apparatus. A separating charger 24 is disposed in a position opposite to the drive roller 18 through the transfer belt 17.

A yellow developing container 7, a magenta developing container 9, a cyan developing container 11 and a black developing container 13 are disposed on the side of the transfer paper tray 46 of the casing of the image forming apparatus. These developing containers are opposed to the photosensitive body belt 1 and are disposed in proximity thereto. Yellow, magenta, cyan and black developing rollers 6, 8, 10 and 12 are respectively attached to the above yellow, magenta, cyan and black developing containers 7, 9, 11 and 13.

An optical writing unit 5 is opposed to the photosensitive body belt 1 on the side of the paper discharging tray 32 in the casing of the image forming apparatus. The optical writing unit 5 is disposed in proximity to the photosensitive body belt 1 and is opposed to the yellow developing container 7 through the photosensitive body belt 1. A synchronization detecting plate 36 (shown in FIG. 2) for detecting synchronization of a laser beam in a main scanning operation is disposed in the vicinity of the optical writing unit 5.

A belt cleaner 29 is disposed in proximity to the photosensitive body belt 1 in a position opposite to the black developing container 13. A charger 4 and a discharging device 30 are disposed between the belt cleaner 29 and the optical writing unit 5 and are opposed to the photosensitive body belt 1. The charger 4 and the discharging device 30 are disposed in proximity to the photosensitive body belt 1.

Figure 2:
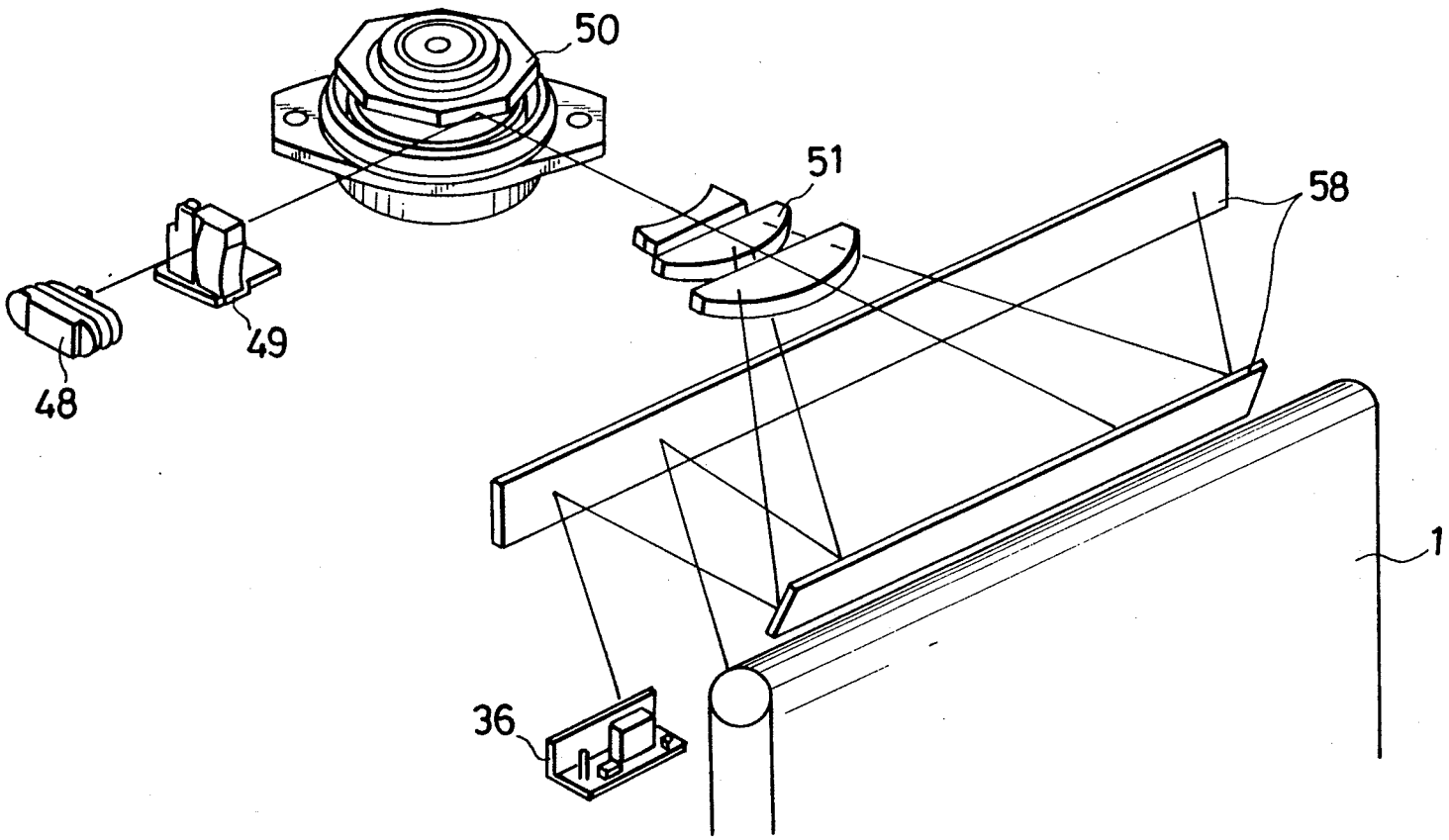
FIG. 2 is a perspective view of a synchronization detecting section in the image forming apparatus.

FIG. 2 is a perspective view showing the construction of a synchronization detecting section in the image forming apparatus in the first embodiment of the present invention. FIG. 2 shows the synchronization detecting plate 36, the photosensitive body belt 1, a polygon mirror 50 and a reflecting mirror 58.

As shown in FIG. 2, a modulated laser beam corresponding to an image of an original is emitted from a laser diode 48. An optical scanning operation with respect to this laser beam is performed by the polygon mirror 50 rotated by an unillustrated motor through a collimator lens 49, thereby exposing the photosensitive body belt 1 charged through an F $\theta$ lens 51.

At this time, the synchronization detecting plate 36 is disposed outside an image region for one scanning. The synchronization of the laser beam on the main scanning line is detected by the synchronization detecting plate 36. One pulse is outputted as a detecting signal from the synchronization detecting plate 36 every one scanning.

Figure 3:
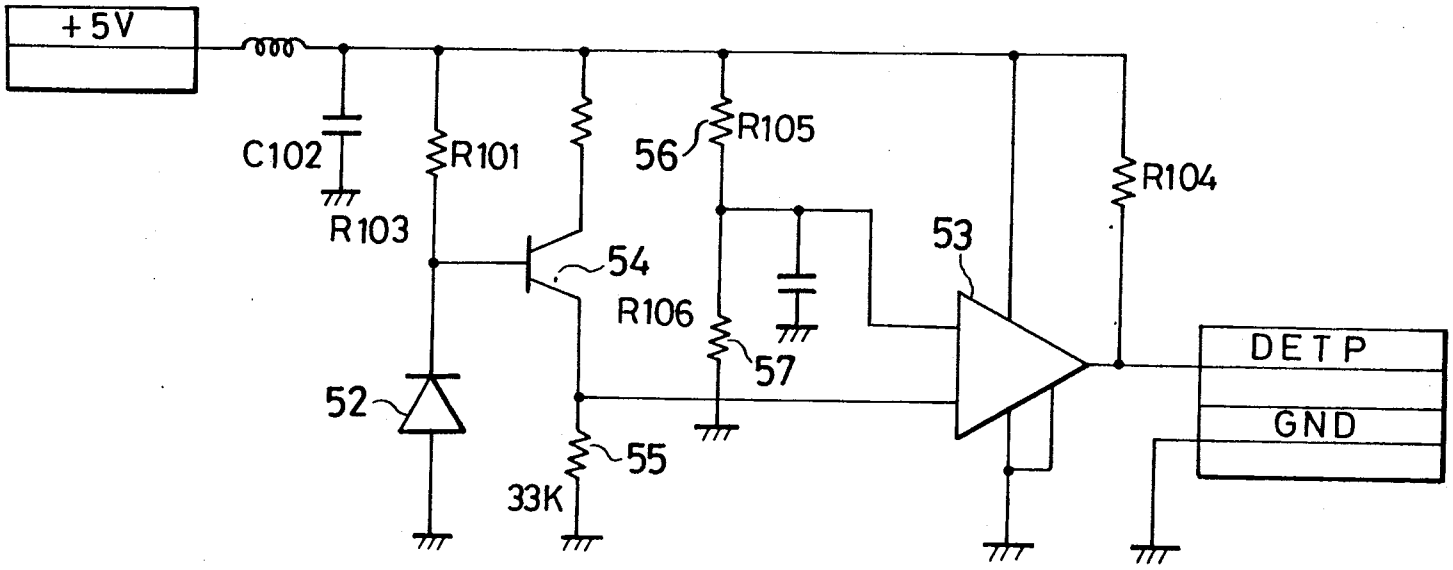
FIG. 3 is a circuit diagram of a synchronization detecting means in the mage forming apparatus.

FIG. 3 shows a circuit of a synchronization detecting means in the first embodiment of the present invention . In FIG. 3, reference numerals 52 and 53 respectively designate a photodiode and a comparator.

As shown in FIG. 3, the photodiode 52 is connected between a base of a transistor 54 and ground. A collector of the transistor 54 is connected to a comparing terminal of the comparator 53. A resistor 55 is connected between the collector of the transistor 54 and the ground. A reference voltage is provided by dividing a bias voltage by resistors 56 and 57 and is applied to a reference terminal of the comparator 53.

Accordingly, when the synchronization of the laser beam on the main scanning line is detected by the photodiode 52, a waveform of the detecting signal is shaped by the comparator 53 and this shaped signal is inputted to a main board described later.

When no sufficient synchronization of the laser beam is performed during a copying operation, a laser output is continuously provided during this copying operation so that a transversal black band is formed in the image. When a synchronization detecting output is abnormal in a standby state of the image forming apparatus, abnormality is displayed in the image forming apparatus.

Figure 4:
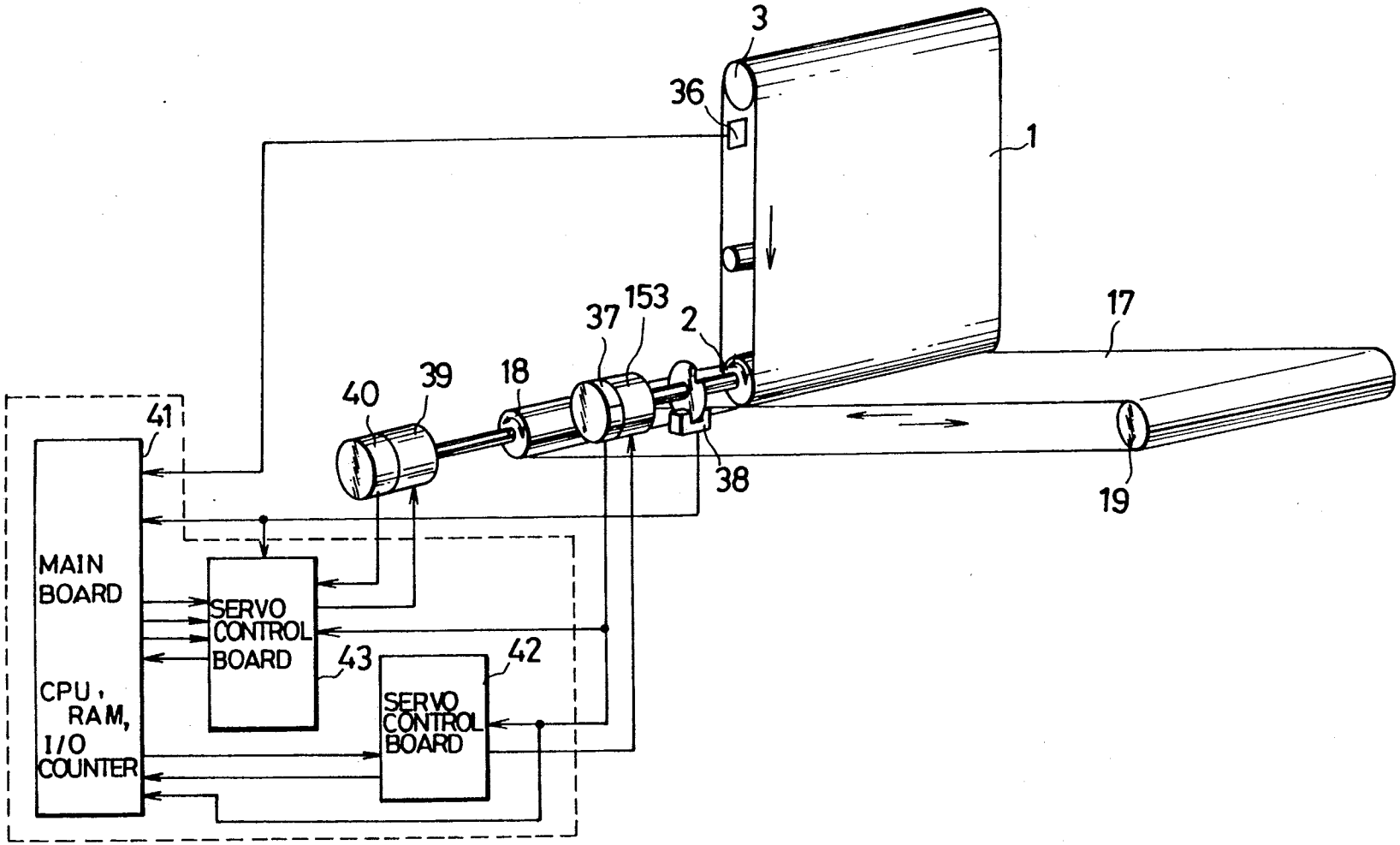
FIG. 4 is an explanatory view showing a control section in the image forming apparatus.

FIG. 4 is an explanatory view showing the construction of a main portion of a control section in the image forming apparatus in the first embodiment of the present invention. FIG. 4 shows the photosensitive body belt 1, the transfer belt 17, a rotation detecting sensor 38, the synchronization detecting plate 36, a main board 41, and servo control boards 42 and 43.

In FIG. 4, the rotation detecting sensor 38 is attached onto a rotary shaft of the drive roller 2 for the photosensitive body belt 1 shown in FIG. 1. A detecting signal of this rotation detecting sensor 38 is inputted to the main board 41 and the servo control board 43.

A drive motor 153 is attached onto a rotary shaft of the drive roller 2 and an encoder 37 for detecting rotation of this drive motor is connected to the drive motor 153. A detecting signal of this encoder 37 is inputted to the servo control boards 42 and 43 and the main board 41. A control signal from the servo control board 42 is inputted to the drive motor 153.

Similarly, a drive motor 39 is attached onto a rotary shaft of the drive roller 18. An encoder 40 for detecting rotation of the drive motor 39 is connected to the drive motor 39. A detecting signal of this encoder 40 is inputted to the servo control board 43. A control signal from the servo control board 43 is inputted to the drive motor 39.

The detecting signal of the synchronization detecting plate 36 is inputted to the main board 41. The main board 41 is electrically connected to the servo control boards 42 and 43.

In the first embodiment of the present invention, the image forming apparatus is constructed such that a gate for starting a writing operation with respect to an image in a sequential operation for forming the image is turned on in synchronization with the detecting signal of the synchronization detecting plate 36.

The operation of the above image forming apparatus will next be described.

First, the features in the operation of the image forming apparatus in the first embodiment of the present invention will be described in comparison with those in the operation of a general image forming apparatus.

Figure 5:
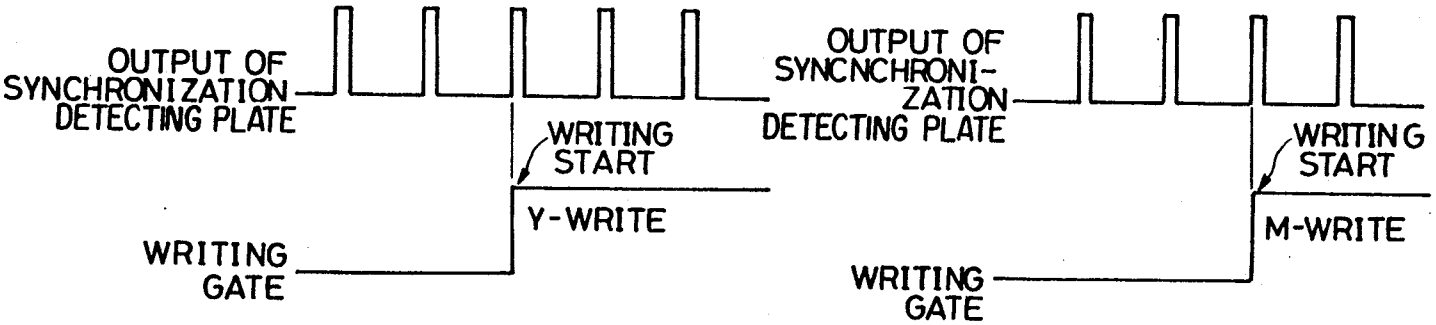
FIG. 5 is a view showing signal waveforms in a sequential operation in the image forming apparatus.

FIG. 5 shows signal waveforms in the sequential operation for forming the image in the first embodiment of the present invention. As shown in FIG. 5, in this embodiment, the gate for starting the writing operation with respect to an image in the sequential operation for forming the image is turned on in synchronization with the detecting signal of the synchronization detecting plate 36 for detecting the synchronization of the laser beam on the main scanning line.

Figure 7:
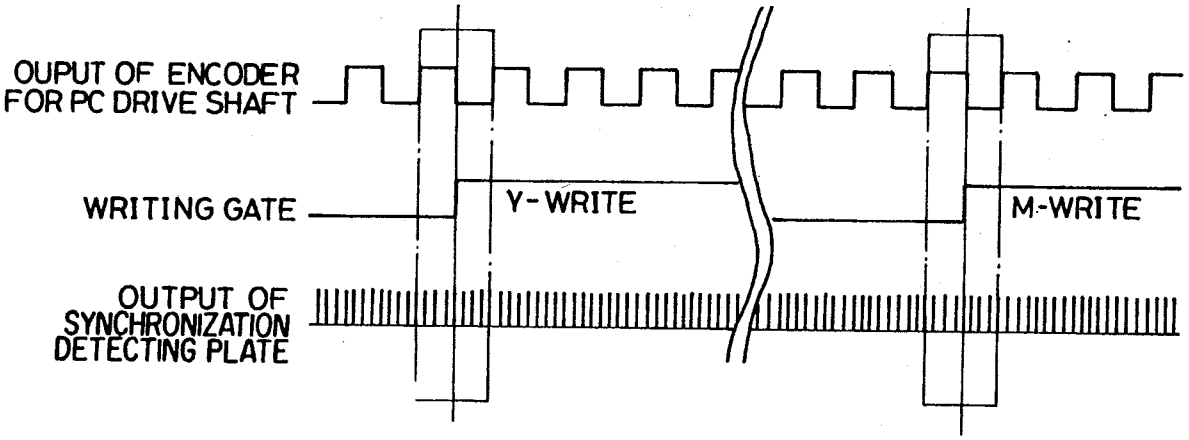
FIG. 7 is a view showing signal waveforms in a general sequential operation for forming an image.
Figure 8:
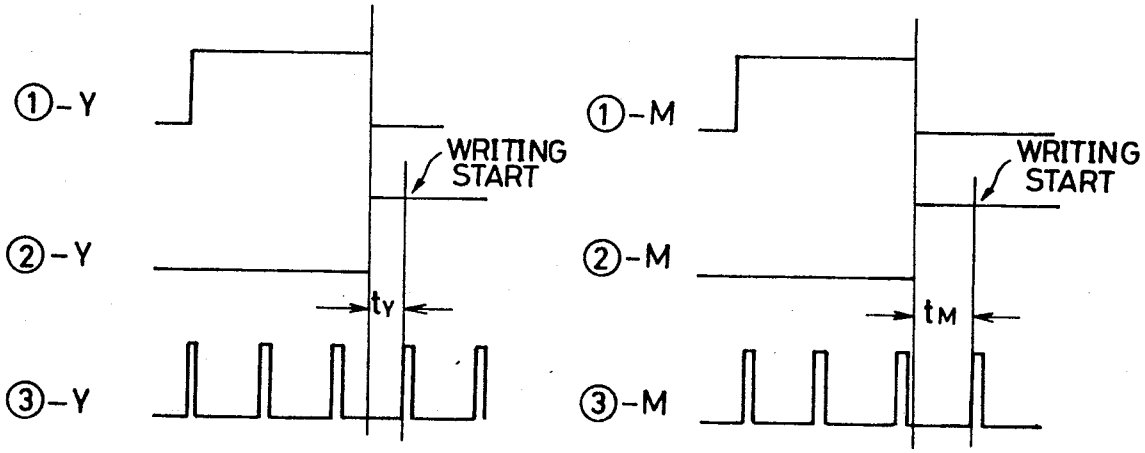
FIG. 8 is a view partially enlarging the signal waveforms shown in FIG. 7.

FIG. 7 is a view showing signal waveforms in the general sequential operation for forming an image. FIG. 8 is a view partially enlarging the signal waveforms shown in FIG. 7.

As shown in FIGS. 7 and 8, in the general image forming apparatus, an encoder output of the drive shaft for the photosensitive body is set as a reference pulse and the image writing start gate is turned on by using this reference pulse. However, the real writing operation is performed in synchronization with the main scanning line of the laser beam. Accordingly, as shown in FIG. 8, the writing operation is started by delaying an original time for starting the writing operation by time $t_Y$ with respect to yellow. The writing operation is started by delaying an original time for starting the writing operation by time $t_M$ with respect to magenta.

Therefore, a shift in color is caused by the difference $t_Y - t_M$ in time in the writing operation with respect to yellow and magenta. For example, in a writing system having 400 dpi, a maximum value of the difference $t_Y - t_M$ in time because one period in the synchronization of the laser beam on the main scanning line, thereby causing the shift in color having a maximum length 25.4 (mm)/400=0.0635 mm.

However, in the first embodiment of the present invention, the image writing start gate is turned on in the sequential operation for forming the image in synchronization with the output signal of the synchronization detecting plate 36. The chage in speed of the photosensitive body belt 1 is set to be sufficiently small so that no shift in color is caused.

In the general sequential operation, the image writing start gate is turned on in synchronization with the rotation of the drive roller 2 of the photosensitive body belt 1 to prevent eccentricities of a gear and the drive roller. However, in this embodiment, as mentioned above, the image writing start gate is turned on in synchronization with the output signal of the syncrhonization detecting plate 36. In this case, the output signal of the synchronization detecting plate 36 can be counted after the writing operation with respect to a first color image is started. Further, the writing operation with respect to each of second to fourth color images can be performed after a time corresponding to an integral rotation of the drive roller 2.

An image forming operation in the image forming apparatus in the first embodiment of the present invention will next be described concretely.

Figure 6A:
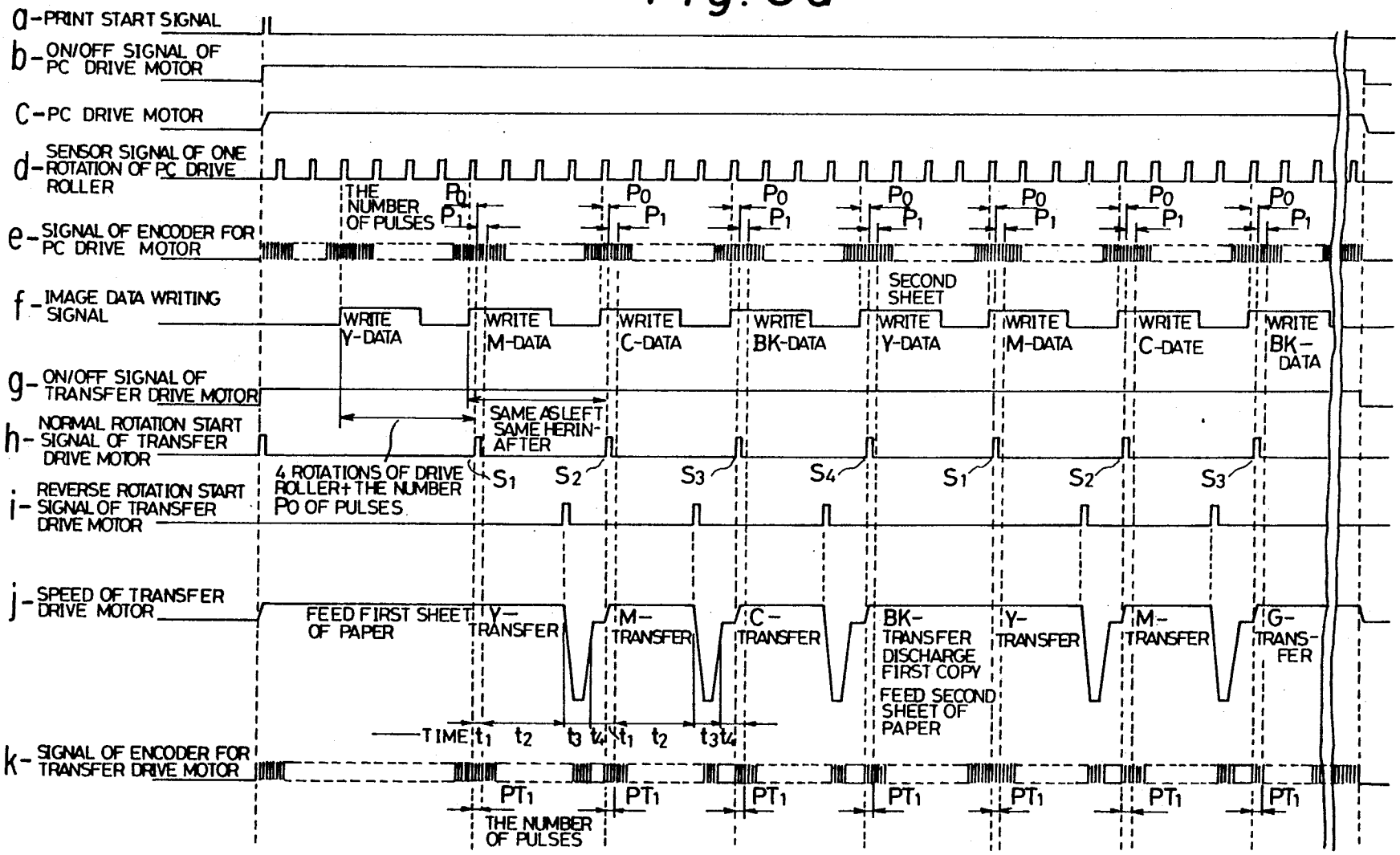
FIGS. 6*a* and 6*b* are views showing signal waveforms showing the operation of the image forming apparatus.
Figure 6B:
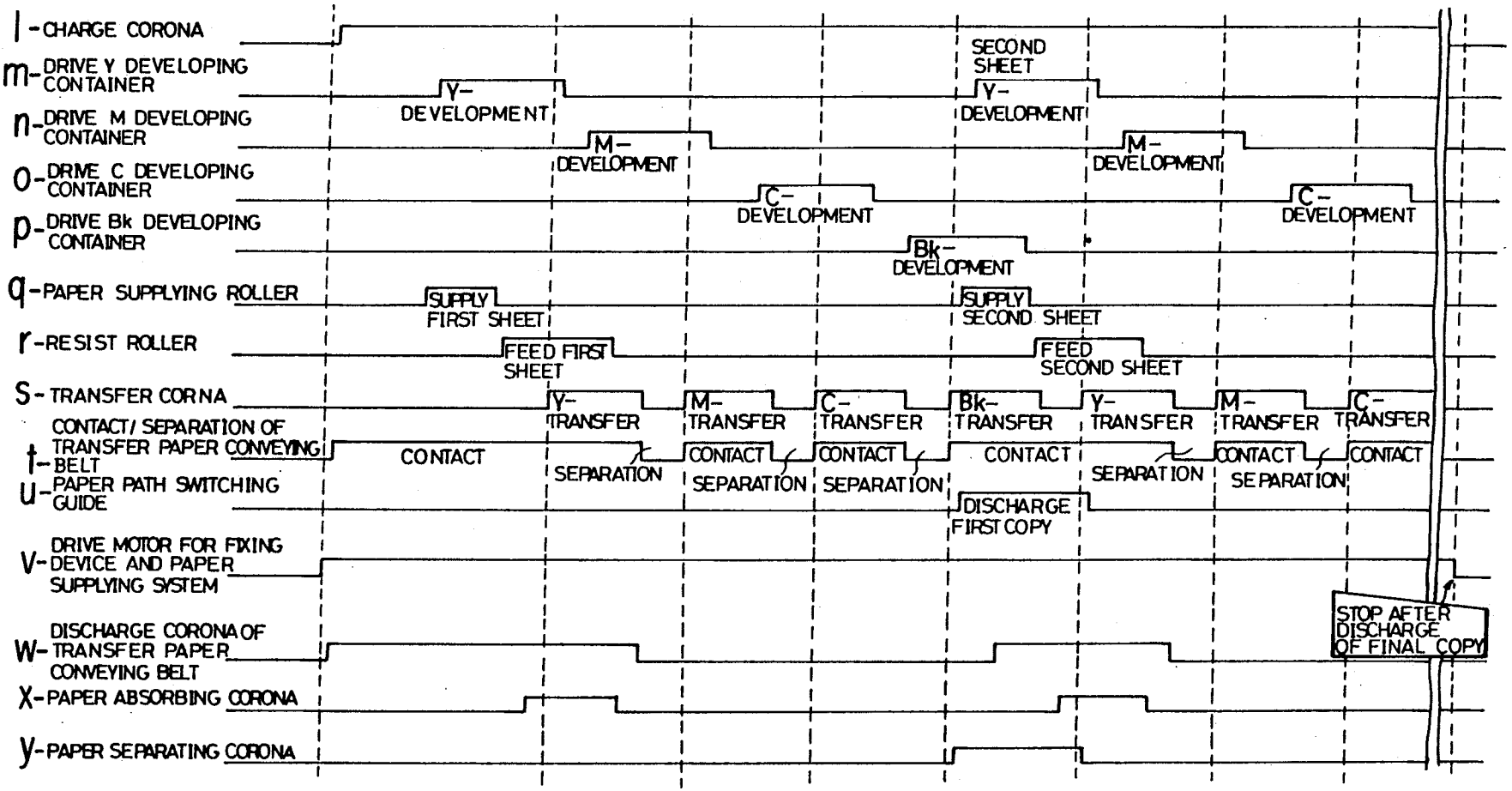

FIGS. 6*a* and 6*b* are views of signal waveforms showing the operation of the image forming apparatus.

The operation of the image forming apparatus in the first embodiment of the present invention will be described with reference to FIGS. 6*a* and 6*b*.

When a printer switch is turned on as shown by item (a) in FIG. 6*a*, the PC drive roller 2 is rotated by the PC drive motor 36 in the clockwise direction so that the photosensitive body belt 1 is moved and rotated at a line speed VP in an arrow direction.

Simultaneously, as shown by signals in item (g) and (h) of FIG. 6*a* and a speed diagram in item (j) of FIG. 6*a*, the transfer belt 17 is moved and rotated at a line speed VF in a left-hand arrow direction by starting and rotating the transfer drive motor 39 in a normal direction thereof. In this case, the movement of the transfer belt is controlled under a condition VP=VF.

The photosensitive body belt (which is called a PC belt in the following description) 1 is discharged by the discharging device 30 and an entire face of this belt is uniformly charged by the charger 4 so as to satisfy the following processing conditions.

1. Light is irradiated onto the PC belt surface from which toner is removed in advance by a PC cleaner. Otherwise, a corona discharging operation is performed on this PC belt surface. Thus, the discharging device sets a surface potential of the PC belt to approximately zero belt.

2. In the case of a negative-positive process, the toner is attached onto an uncharged surface portion of the photosensitive body. Accordingly, the entire surface of the PC belt must be uniformly charged by the charger.

3. The charge performs a uniform charging operation by corona discharge. In this case, ozone is slightly caused by this corona discharge. This ozone is decomposed for a short time when the discharging operation is stopped. However, there is a case in which the PC belt surface is adversely affected by this ozone so that an image becomes unclear. Therefore, air is supplied or sucket by a fan, etc. backward from an unillustrated charger to remove an influence of the ozone.

The rotation detecting sensor 38 is arranged on the shaft of the PC drive roller 2 and outputs a detecting pulse every one rotation of this roller as shown by item (d) of FIG. 6*a*.

In the example shown in FIG. 6*a*, a semiconductor laser (which is called an LD in the following description) in the optical writing unit begins to be controlled and operated at a timing of a third pulse from this one rotation detecting sensor. Another optical writing unit composed of another type laser, an LED array, an LCD array, etc. may be used instead of the semiconductor laser. First, the optical writing operation based on yellow image data is started and an electrostatic latent image is formed.

In this case, as already explained with reference to FIG. 5, the image writing start gate is turned on in synchronization with the output signal of the synchronization detecting plate 36 for detecting the synchronization of the laser beam on the main scanning line.

Therefore, no difference in time based on the writing start time with respect to each color is caused so that the shift in color is prevented at the image forming time.

Decomposed lights such as blue, green and red color lights are respectively read by the reading device 35 for reading a color image and arranged in an upper portion of the image forming apparatus in FIG. 1. The above image data are provided as writing image data with respect to each color of yellow, magenta, cyan and black by performing an image processing based on an intensity level of each color light.

The above image data may be constructed by image data outputted from another color image processing system such as a color facsimile, a word processor, a personal computer, etc. A connection interface for this color image processing system may be individually disposed.

The developing containers 7, 9, 11 and 13 for developing an electrostatic latent image are normally disposed in positions in which the developing rollers 6, 8, 10 and 12 do not come in contact with the PC belt surface. One of the developing containers corresponding to a certain color is pressed in the left-hand direction in FIG. 1 only just before and after a latent image face having the corresponding color reaches the developing roller with respect to this color. Thus, the position of the developing roller is set to a position in which the developing roller comes in contact with the photosensitive body face by a predetermined amount.

Simultaneously, the developing roller and a portion for performing a developing operation begins to be operated so as to provide a developing performance with respect to only this developing container (see items (m) to (p) of FIG. 6*b*).

Since the latent image with respect to the yellow image is first formed, the yellow developing container 7 comes in contact with the photosensitive body face and is operated at a predetermined timing as shown by item (m) of FIG. 6*a*, thereby developing the yellow image.

A transfer processing will next be performed. Upper and lower positions of the roller 20 are switched such that the transfer belt 17 comes in contact with the PC belt face in a transfer section (a PC drive roller section) as shown in FIG. 1.

When a printing operation is started, the transfer belt 17 is moved in the left-hand arrow direction as mentioned above. Thereafter, the switching roller 20 for the contact and separation of the transfer belt is pressed toward the upper position thereof such that the transfer belt 17 comes in contact with the PC belt 1 as shown by item (t) of FIG. 6*b*.

Then, a sheet of transfer paper 14 is supplied by the paper supplying roller 15 at a predetermined timing. The sheet of transfer paper is then conveyed onto the transfer belt 17 by a resist roller 16 at a predetermined timing at which the position of the sheet of transfer paper is in conformity with the position of an image formed on the PC belt face.

As shown by item (x) of FIG. 6*b*, the corona discharging operation of a predetermined polarity is performed by the paper adsorbing charger 23 with respect to the conveyed sheet of transfer paper 14. Thus, the sheet of transfer paper 14 comes in close contact with the transfer belt such that no position of the sheet of transfer paper is shifted during the transfer operation. The above switching roller 20 for the contact and separation of the transfer belt is also used as an electrode opposite to the paper adsorbing charger 23 so as to simplify the construction of the image forming apparatus.

The entire face of the transfer belt is uniformly discharged by a corona discharging portion 22 before the transfer process with respect to the first color as shown by item (w) of FIG. 6*b*. At this time, the transfer belt is cleaned by a cleaner 25 (see FIG. 1 for example).

When a front end of the developed yellow image has reached a point Ts separated from a transfer point T by a predetermined distance, a signal $S_1$ for starting the normal rotation of the transfer drive motor 39 is inputted to the control drive circuit (servo control board) 43 of the transfer drive motor 39 as shown by item (h) of FIG. 6*a*.

In this case, the transfer drive motor 39 is already rotated in the normal direction at the time point of the signal $S_1$ so that the normal rotation of this transfer drive motor is continued as shown by item (i) of FIG. 6*a*.

At the time point of the signal $S_1$, the front end of the sheet of transfer paper has substantially reached a point RT located before the transfer position T by a distance $l_1$. Further, at the time point of the signal $S_1$, the front end of the yellow image on the PC belt has reached the point Ts located before the point T by the distance $l_1$.

In the example shown in FIG. 6*a*, at the time point of the signal $S_1$, the PC drive roller is rotated four times and is further rotated by the number $P_O$ of pulses of the encoder 37 for the PC drive motor from the writing start timing of the yellow image data as shown by items (d). (e), (f) and (h) of FIG. 6*a*.

In the meantime, the PC belt is moved by a distance from a point E indicative of an image writing position to the point Ts (see FIG. 1).

After a time $t_1$ has passed from the time point of the signal $S_1$, the front end of the yellow image and the front end of the sheet of transfer paper are moved by the distance $l_1$ and has reached the transfer point T. Thereafter, the transfer processing with respect to the yellow image is performed by the transfer corona charger 21.

The number of pulses of the encoder 37 for the PC drive motor is $P_1$ and the number of pulses of the encoder 40 for the transfer drive motor is $PT_1$ at this time $t_1$ as shown by items (e) and (k) of FIG. 6*a*. $P_1=PT_1$ is formed when both the belts are moved by the same distance per one pulse with respect to resolution of both the encoders. When a ratio of moving distances of both the belts per one pulse is $\alpha$, the numbers $P_1$ and $PT_1$ of pulses are values corresponding to this ratio $\alpha$.

In the first embodiment of the present invention, the condition $P_1=PT_1$ is set in the following description.

When the transfer processing with respect to the yellow image proceeds, the front end of the sheet of transfer paper is separated from the transfer belt. The front end of the sheet of transfer paper is further moved toward the paper end guide plate 27 through the transfer paper path switching member 26 shown by a solid line.

When the transfer processing with respect to the yellow image further proceeds, the sheet of transfer paper is moved by a distance $l_1+l_P$(size of the sheet of transfer paper)$+l_2$ from the time point of the signal $S_1$ when a rear end of the sheet of transfer paper is moved from the point T by the distance $l_2$. At this time $(t_1+t_2)$, the transfer drive motor is rotated by a reverse signal in the reverse direction thereof as shown by items (i) and (j) of FIG. 6*a* and the sheet of transfer paper 14 is located in a position 34 shown by a two-dotted chain line.

The switching roller 20 for the contact and separation of the transfer belt is moved to the lower position thereof before the reverse rotation of the transfer drive motor. Thus, the transfer belt is separated from the PC belt face.

The transfer belt and the sheet of transfer paper are quickly returned by the reverse rotation of the transfer drive motor at a speed VR (>VF) in the direction of a right-hand arrow. At this time, the positions of the transfer belt and the sheet of transfer paper are controlled and returned in the right-hand direction for a short returning time $t_3$ by a distance equal to the distance moved in the left-hand direction for the time $t_1+t_3$.

At this returning time, a terminal end of the sheet of transfer paper is separated from the transfer belt and is moved toward the paper rear end guide plate 28. Thus, the sheet of transfer paper is accurately returned by a predetermined distance and the sheet of transfer paper 14 is stopped in a position 33 shown by a two-dotted chain line in which the position of the front end of the sheet of transfer paper is located at the point RT. Thus, at a time $t_4$, the image forming apparatus attains a standby state for the transfer processing with respect to a magenta image as a second color image.

The magenta image as a second color image is already formed on the PC belt 1 while the yellow image as a first color image is transferred onto the sheet of transfer paper. Namely, a latent image based on magenta image data begins to be optically written and formed by the control and operation of the semiconductor laser when the PC drive roller is rotated integral times such as four times in the case of FIGS. 6*a* and 6*b* from the beginning of the writing operation of the yellow image.

The yellow developing container 7 comes in contact with the Pc belt face and is operated only in a yellow image region. The yellow developing container 7 is separated from the PC belt face and the operation of this container is stopped before a magenta image region with respect to the second color reaches the yellow developing container.

As shown by item (n) of FIG. 6*b*, the magenta developing container 8 comes in contact with the PC belt face and is operated before a front end of the magenta image region reaches the magenta developing container after the yellow image region has passed through the magenta developing container. Thus, only the latent image region for the magenta image is developed as the magenta image.

Similar to the case of the yellow image with respect to the first color, when a front end of the magenta image has reached the point Ts, the PC drive roller is rotated four times and is further rotated by the number $P_O$ of pulses of the encoder 37 for the PC drive motor from the writing start timing of magenta image data. At this time point, a signal $S_2$ for starting the normal rotation of the transfer drive motor is inputted to the control drive circuit (servo control board) 43.

Simultaneously or slightly after the input of the signal $S_2$, the switching roller 20 for the contact and separation of the transfer belt begins to be pressed toward the upper position thereof. Thus, this roller 20 comes in contact with the transfer belt until at least the front end of the sheet of transfer paper reaches the point T.

Similar to the case of the yellow image, with respect to the PC belt 1, the number of pulses of the encoder for the PC drives motor is $P_1$ and the PC belt face is moved by the moving distance $l_1$ for the time $t_1$ forming the timing of the signal $S_2$.

The speed of the sheet of transfer paper is increased from zero to the speed VF(=VP) for this time $t_1$. In the meantime, the position of the sheet of transfer paper is controlled to provide the number of pulses equal to the number $PT_1$ of pulses for the time $t_1$ from the time point of the signal $S_1$ with respect to the first color, thereby forming $P_1=PT_1$.

Thus, the front end of the sheet of transfer paper is moved by the distance $l_1$ for the time $t_1$ and the yellow and magenta images with respect to the first and second colors are aligned with each other on the sheet of transfer paper.

Thereafter, the above-mentioned processings are repeatedly performed. Namely, the magenta image is transferred onto the sheet of transfer paper and the sheet of transfer paper is quickly returned. Further, the writing operation of cyan image data, cyan development and the transfer operation of a cyan image are performed. Then, the sheet of transfer paper is quickly returned and the writing operation of black image data, black development and the transfer operation of a black image are performed.

The operation of the image forming apparatus after the transfer operation of the black image will next be described.

In the transfer process of the black image, the paper path switching guide plate 26 is switched to a position shown by a one-dotted chain line. In the transfer process, the sheet of transfer paper is moved toward the fixing device 31 while the sheet of transfer paper is discharged by a paper separating charger from a front end thereof. The transfer drive motor is continuously rotated in the normal direction even when the transfer operation with respect to a rear end of the sheet of transfer paper is completely performed. Thus, the sheet of transfer paper is conveyed in the left-hand direction and a fixed color print is discharged onto the tray 32 as shown by items (j), (u), (v) and (y) of FIG. 6*b*.

At this time, as shown by item (w) of FIG. 6*b*, the transfer belt 17 is uniformly discharged by performing a corona discharging operation from the timing at which a rear end portion of the first sheet of transfer paper in an image region thereof has passed through a discharging device 22.

When the processings shown in FIGS. 6*a* and 6*b* are repeatedly performed, the black image data are written onto the first sheet of transfer paper. Thereafter, as shown in FIGS. 6*a* and 6*b*, yellow image data are written to a second sheet of transfer paper. The operations and controls of the second sheet of transfer paper and the transfer belt are similar to those in the case of the firstt sheet of transfer paper.

The remaining toner is removed from the PC belt 1 by the cleaner 29 after the transfer processing. Further, the remaining charge is removed from the PC belt by the discharging device 30 and the PC belt is then moved toward the charger 4.

A final color print is thus discharged onto the tray 32 and the PC belt 1 and the transfer belt 17 are cleaned and discharged. Thereafter, the operations of the PC belt 1 and the transfer belt 17 are stopped and the operating state of the image forming apparatus is returned to its initial state.

In the above description, the image is formed in an order of yellow, magenta, cyan and black and the yellow, magenta, cyan and black devoloping containers are sequentially arranged from above. However, the present invention is not limited to such an arrangement.

Further, in the above description, the electrostatic latent image of each color is optically written and formed by a semiconductor laser, etc. using digitally processed image data of each color. However, a color image is similarly recorded by forming an analog optical image provided by a normal electrophotographic copying machine at the point E by controlling the position of this optical image at a predetermined timing.

In the above description, the yellow, magenta, cyan and black color images are overlapped. When two or three colors of such four colors are overlapped, the operations of the respective constructional portions of the image forming apparatus are controlled such that the formation and transfer of an image having a required color are sequentially performed two or three times, thereby completing the formation and transfer thereof.

In the case of a single color, the developing container of this color comes in contact with the PC belt and is operated until the image is completely formed on a predetermined number of sheets of transfer paper. The transfer belt continuously comes in contact with the PC belt. The paper path switching guide plate 26 is held in a position for guiding the sheet of transfer paper toward the fixing device 31 to perform a fixing operation.

Accordingly, when the images are repeatedly formed, a print making speed in the case of three colors is 4/3 times that in the case of four colors. Further, the print making speed in the case of two colors or a single color is respectively two or four times that in the case of four colors, thereby performing the image forming operation at a high speed.

The developing colors are not limited to the four colors mentioned above, but it is possible to combine and use blue, green, red and other desirable colors in accordance with necessity.

As mentioned above, in accordance with the present invention, the timing for starting the writing operation with respect to each color is synchronized with the main scanning operation of the laser beam. Therefore, it is possible to form an image having no shift in color. Further, in a switching-back operation of the transfer paper conveying belt, the operations of the photosensitive body bely and the transfer belt are controlled by two separate servo motors. Therefore, the accuracy in constant rotation of the belts is high and the image having no shift in color is formed.

Further, it is possibel to omit an encoder of the drive roller for the photosensitive body belt so that the cost of the image forming apparatus can be reduced. Further, it is possible to remove a bad influence of the apparatus caused by eccentricity of the drive roller of the photosensitive body belt.

Figure 10:
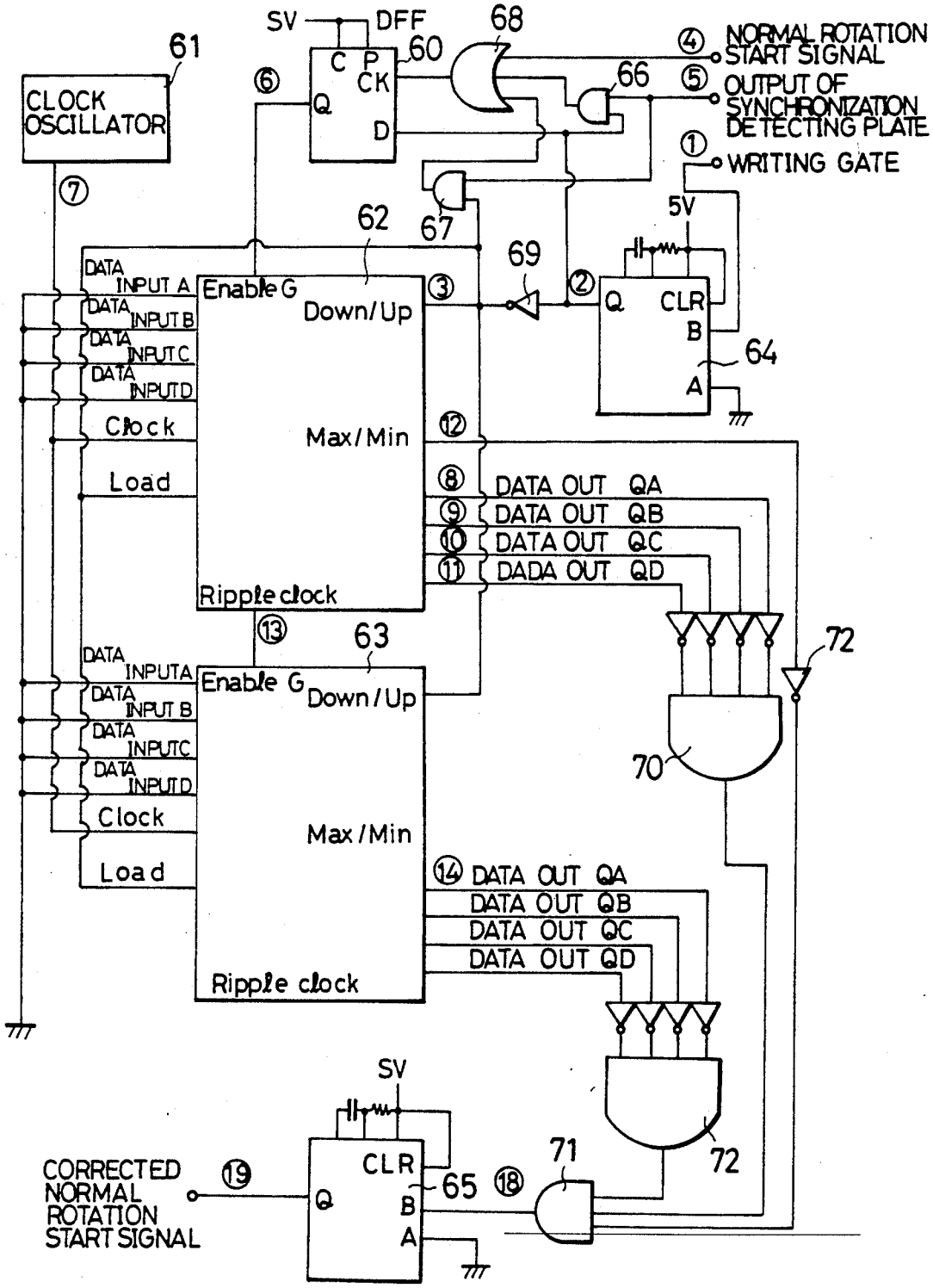
FIG. 10 is a circuit diagram of a correcting circuit in an image forming apparatus in a second embodiment of the present invention.
Figure 11:
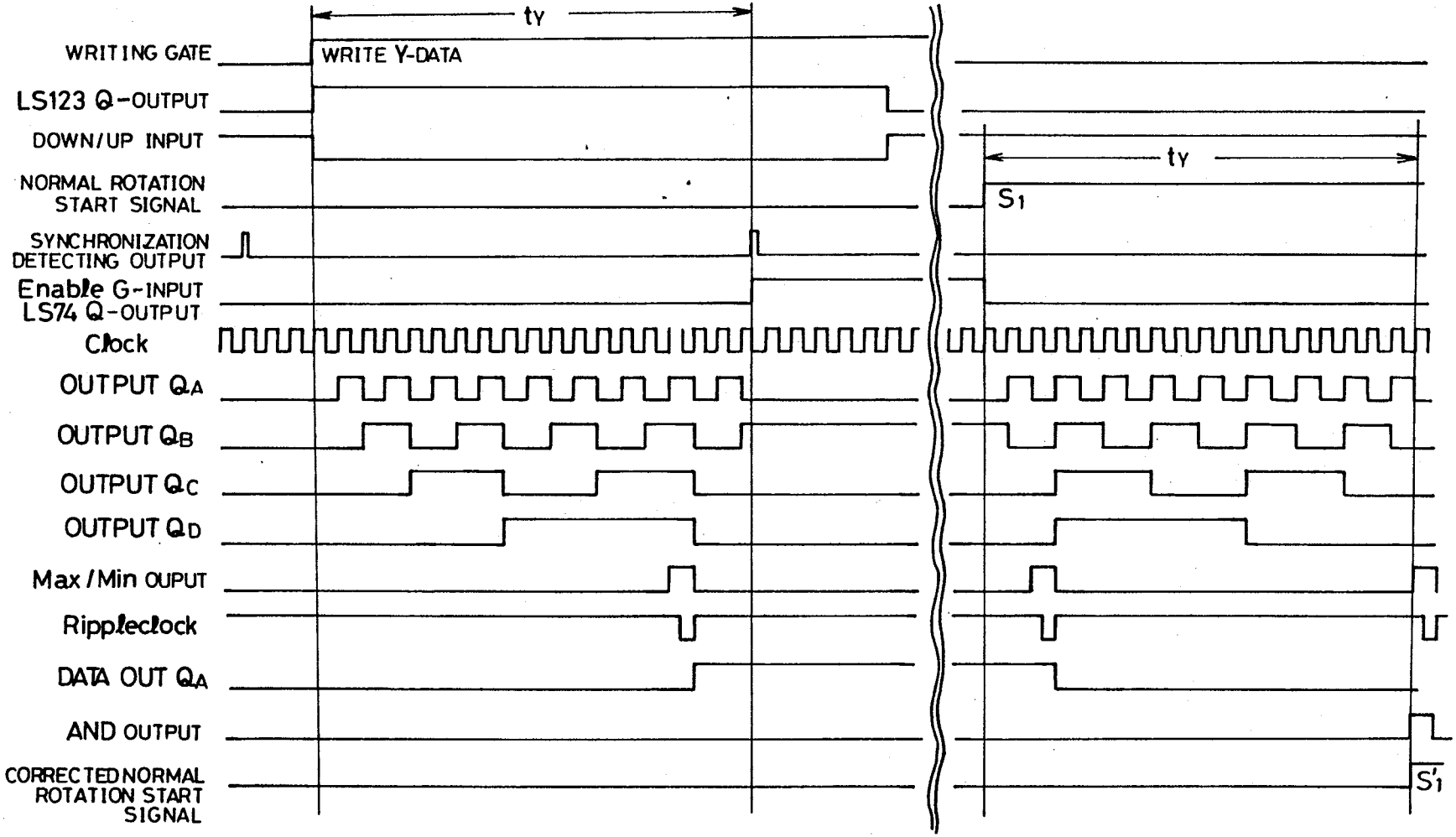
FIG. 11 is a view of signal waveforms showing the operation of the image forming apparatus in FIG. 10.

FIGS. 10 and 11 show an image forming apparatus in a second embodiment of the present invention. In this embodiment, the image forming apparatus has a correcting circuit which detects a time lag from a time point of a command for starting the optical writing operation each time to a start time point of the actual writing operation and corrects this time lag.

The time lag to be corrected by this correcting circuit will next be described in the following description.

Figure 9:
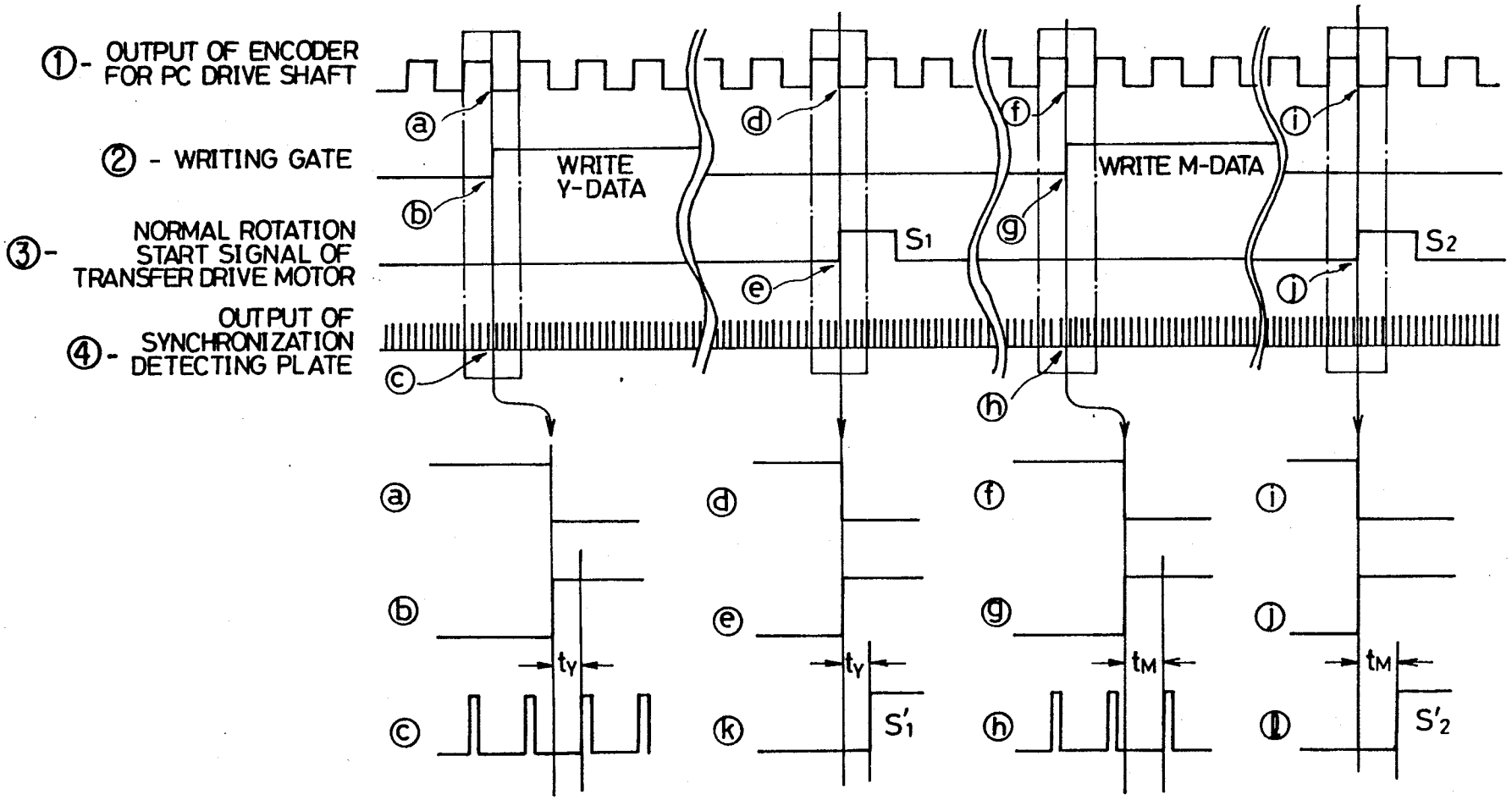
FIG. 9 is a view for explaining a shifting amount in a correcting circuit in a general image forming apparatus.

FIG. 9 is a view showing signal waveforms for explaining the operation of a general image forming apparatus. Item ① designates an output signal of the encoder 38 attached onto the drive shaft 2 in FIG. 4. Item ② designates a write signal of image data. Item ③ designates a signal for starting the normal rotation of the transfer drive motor. Item ④ designates a detecting signal of the synchronization detecting plate 36.

As shown in FIG. 9, the output signal of the encoder 38 on the drive shaft 2 is set as a basic pulse in a sequential operation of the image forming apparatus. A timing signal for turning a writing gate on with respect to each color and the signal for starting the normal rotation of the transfer drive motor are outputted in synchronization with a trailing edge of the output signal of the encoder 38.

Therefore, as can be seen from enlarged signal portions (a), (b) and (c) in FIG. 9 at the writing time of yellow data, the actual writing operation is started after a signal of the writing gate rises and when the next output signal of the synchronization detecting plate 36 is supplied. Accordingly, the start of the writing operation is delayed by a time lag $t_Y$.

Similarly, as can be seen from enlarged signal portions (f), (g) and (h) in FIG. 9, the start of the writing operation with respect to magenta data is also delayed by a time $t_M$.

As can be seen from enlarged signal portions (d), (e), (i) and (j) in FIG. 9, normal rotation start signals $S_1$ and $S_2$ for overlapping and transferring yellow and magenta images are synchronization with the output signal of the encoder 38. Therefore, in this state, when the yellow and magenta images are overlapped and transferred onto a sheet of transfer paper, a shift in color with respect to the yellow and magenta images is caused by a time lag $|t_Y - t_M|$.

Therefore, in the correcting circuit in the image forming apparatus in the second embodiment of the present invention, the above writing start lag times $t_Y$ and $t_M$ are added to the times of the respective normal rotation start signals $S_1$ and $S_2$. Such normal rotation start signals are inputted to the servo control board at a timing shown by enlarged signal portions (k) and (l) in FIG. 9.

FIG. 10 shows the correcting circuit in the image forming apparatus in the second embodiment of the present invention. In this FIG., reference numerals 60 and 61 respectively designate a D-type flip flop circuit and a clock oscillator. Updown counters 62 and 63 are cascade-connected to each other. Reference numerals 64 and 65 designate flip flop circuits.

As shown in FIG. 10, the output signal of the synchronization detecting plate 36 is inputted to one input terminal of each of AND circuit 66 and 67. The other input terminal of each of the AND circuits 66 and 67 is connected to a D-terminal of the D-type flip flop circuit 60 and a Load terminal and a Down/Up terminal of each of the updown counters 62 and 63. Output terminals of the AND circuits 66 and 67 are connected to input terminals of an AND circuit 68. A normal rotation start signal is also inputted to the AND circuit 68. An output terminal of the AND circuit 68 is connected to a CK terminal of the D-type flip flop circuit 60. A Q-terminal of the D-type flip flop circuit 60 is connected to an Enable terminal of the updown counter 62.

A writing gate signal is inputted to a B-terminal of the flip flop circuit 64. A Q-terminal of the flip flop circuit 64 is connected to the D-terminal of the D-type flip flop circuit 60 and the Down/Up terminals of the updown counters 62 and 63 through an inverting circuits 69.

Data signals $Q_A$ to $Q_D$ outputted from respective output terminals of the updown counter 62 are inverted and inputted to an AND circuit 70. Data signals $Q_A$ and $Q_D$ outputted from respective output terminals of the updown counter 63 are inverted and inputted to an AND circuit 72. A Max/Min terminal of the updown counter 62 is connected to an input terminal of an AND circuit 71 through an inverting circuit 72. Output terminals of the AND circuits 70 and 72 are connected to input terminals of the AND circuit 71.

An output terminal of the AND circuit 71 is connected to a B-terminal of a flip flop circuit 65. A corrected normal rotation start signal is outputted to a Q-terminal of the flip flop circuit 65.

An output terminal of the clock oscillator 61 is connected to Clock terminals of the updown counters 62 and 63. Data input terminals A to D of the updown counters are connected to ground.

FIG. 11 is a view of signal waveforms for explaining the operation of the correcting circuit in FIG. 10. The data signals $Q_A$ to $Q_D$ are inputted from the updown counter 62 to the AND circuit 70. The data signals $Q_A$ to $Q_D$ are inputted from the updown counter 63 to the AND circuit 72.

The voltage level of a signal in the output terminal of the AND circuit 71 becomes high after a time $t_Y$ from the normal rotation start signal $S_1$. Correspondingly, a corrected normal rotation start signal is obtained in the Q-terminal of the flip flop circuit 65.

When the normal rotation start signals $S_1'$ and $S_2'$ shown in FIG. 9 are obtained, it is possible to correct a shift in color between yellow and magenta images. Similarly, it is possible to correct the shift in color between the respective color images.

Counting-up and counting-down operations can be performed with a maximum counting value 256 by the updown counters 62 and 63 cascade-connected to each other by using the correcting circuit in FIG. 10. It is possible to output the write lag time and the corrected normal rotation start signal with resolution 1/256 times a period on one main scanning line.

If a line density 16 line/mm and a line speed 120 mm/sec are set in a writing system, an output frequency $f_C$ of the used clock oscillator 61 is provided by the following formula.

$$f_c = \{(\text{period on one main scanning line}) \times 1/256\}^{-1} = \{((\text{the number of lines}) \times (\text{line speed}))^{-1} \times 1/256\}^{-1} \approx 490\ (\text{kHz}) \quad (1)$$

To further improve the resolution, the clock frequency is increased by increasing the number of cascade connection stages. In FIG. 11, the width of an output pulse of the flip flop circuit 64 is set to be longer than the period on one main scanning line and shorter than a period on two main scanning lines by a capacitor and a resistor connected to the exterior of the correcting circuit.

The operation of the image forming apparatus in the second embodiment of the present invention is similar to that described with reference to FIGS. 6a and 6b.

In this case, as mentioned above, the normal rotation start signal correcting the write lag time is outputted by using the correcting circuit shown in FIG. 10. Thus, the writing operation is performed by the detecting signal of the synchronization detecting plate 36 at a timing at which the writing gate with respect to each color is turned one, thereby preventing the shift in color.

In the general image forming apparatus, the shift in color on one line in the case of a general line density 16 lines/mm is 60 μm at its maximum. However, in this embodiment, the shift in position of an image on the sheet of transfer paper caused by dispersion of the writing timing with respect to yellow, magenta, cyan and black can be completely neglected.

FIGS. 12 to 15 are views for explaining main portions in image forming apparatusses in third to sixth embodiments of the present invention. In these figures, the same portions as those in FIG. 1 are designated by the same reference numerals.

Figure 12:
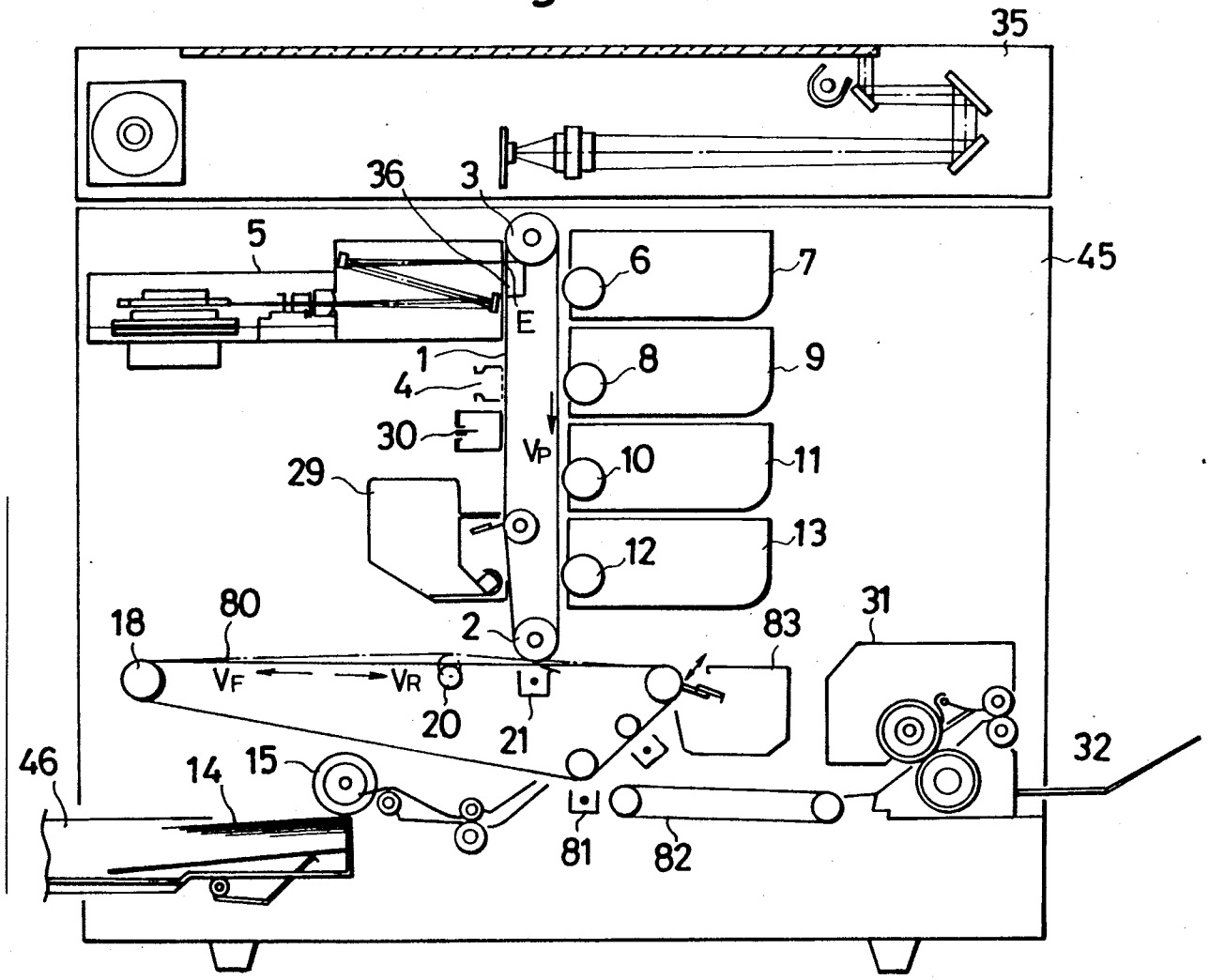
FIGS. 12 to 15 are views respectively showing image forming apparatuses in third to sixth embodiments of the present invention.

In FIG. 12, reference numerals 80, 81, 82 and 83 respectively designate an intermediate transfer belt, a transfer corona portion, a unit for conveying the sheet of transfer paper, and a cleaner for cleaning the intermediate transfer belt. In this embodiment, images are sequentially overlapped and transferred onto the reciprocating intermediate transfer belt 80. The transferred images are finally transferred once onto the sheet of transfer paper from the intermediate transfer belt 80.

Figure 13:
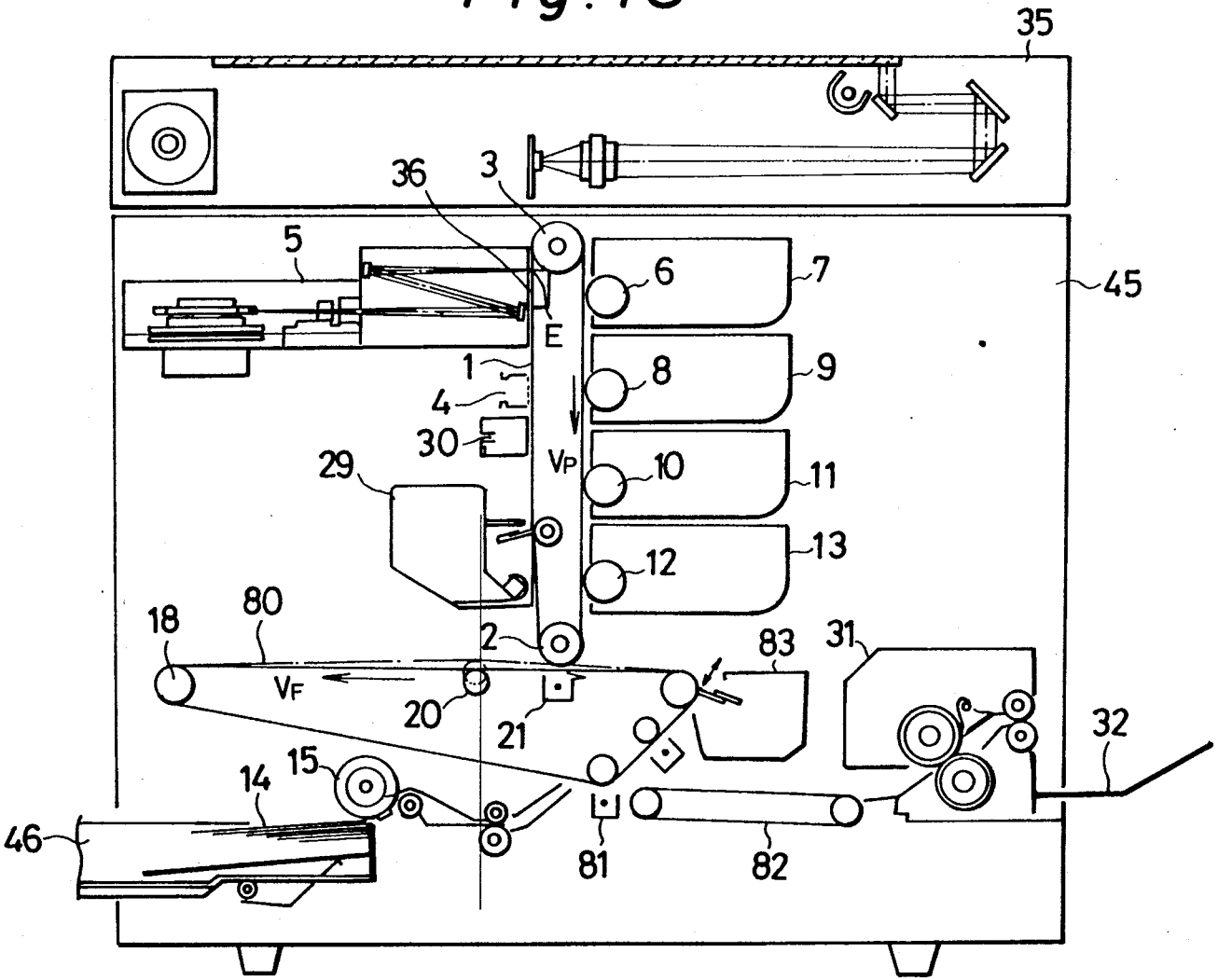

The construction of the image forming apparatus in FIG. 13 is approximately similar to that in FIG. 12. The intermediate transfer belt 80 is reciprocated in FIG. 12. However, in this embodiment shown in FIG. 13, an intermediate transfer belt 80 is moved in a forward direction and the movement thereof can be temporarily stopped and the intermediate transfer belt can be skipped at a high speed.

Figure 14:
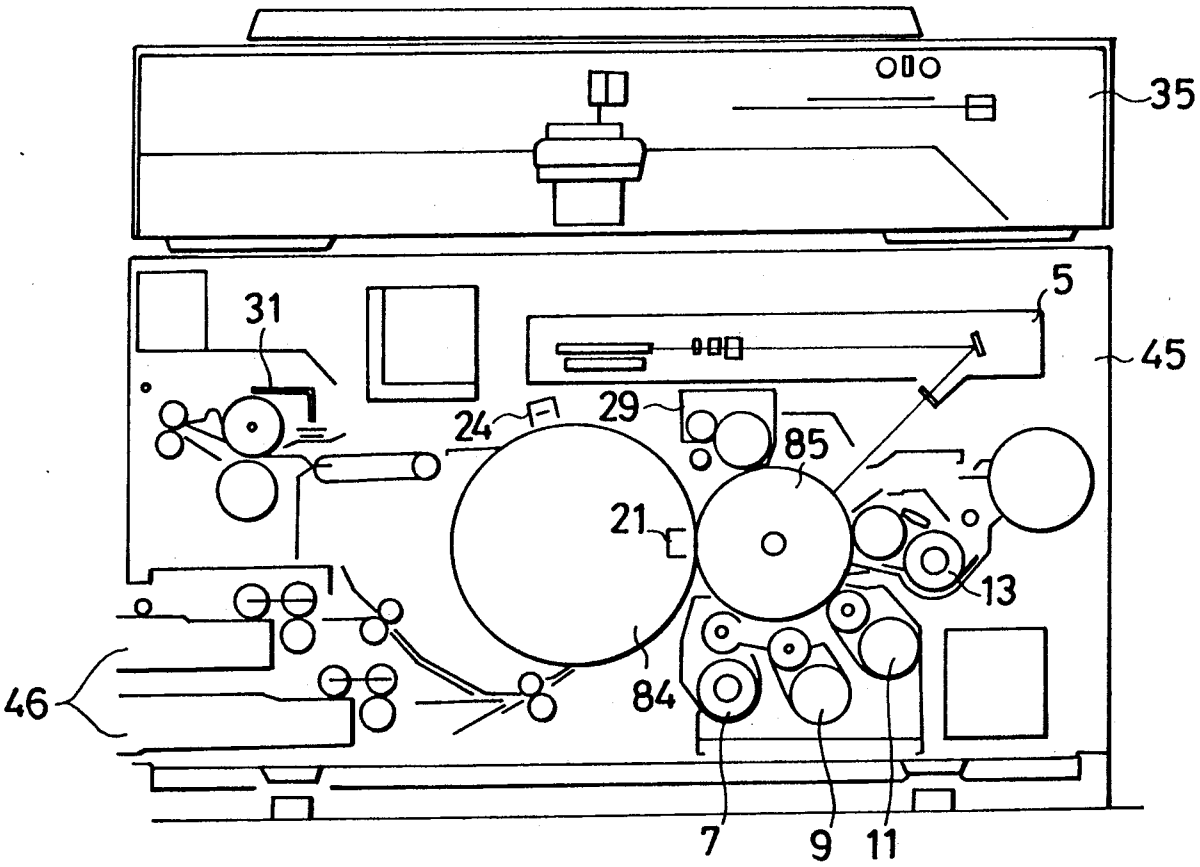

In FIG. 14, reference numerals 84 and 85 respectively designate first and second transfer drums. In this embodiment, the first transfer drum 84 supports a sheet of transfer paper and the second transfer drum 85 supports a transfer belt. The first and second transfer drums are rotated in only a forward direction. The positions of the first and second transfer drums are controlled every transfer start.

Figure 15:
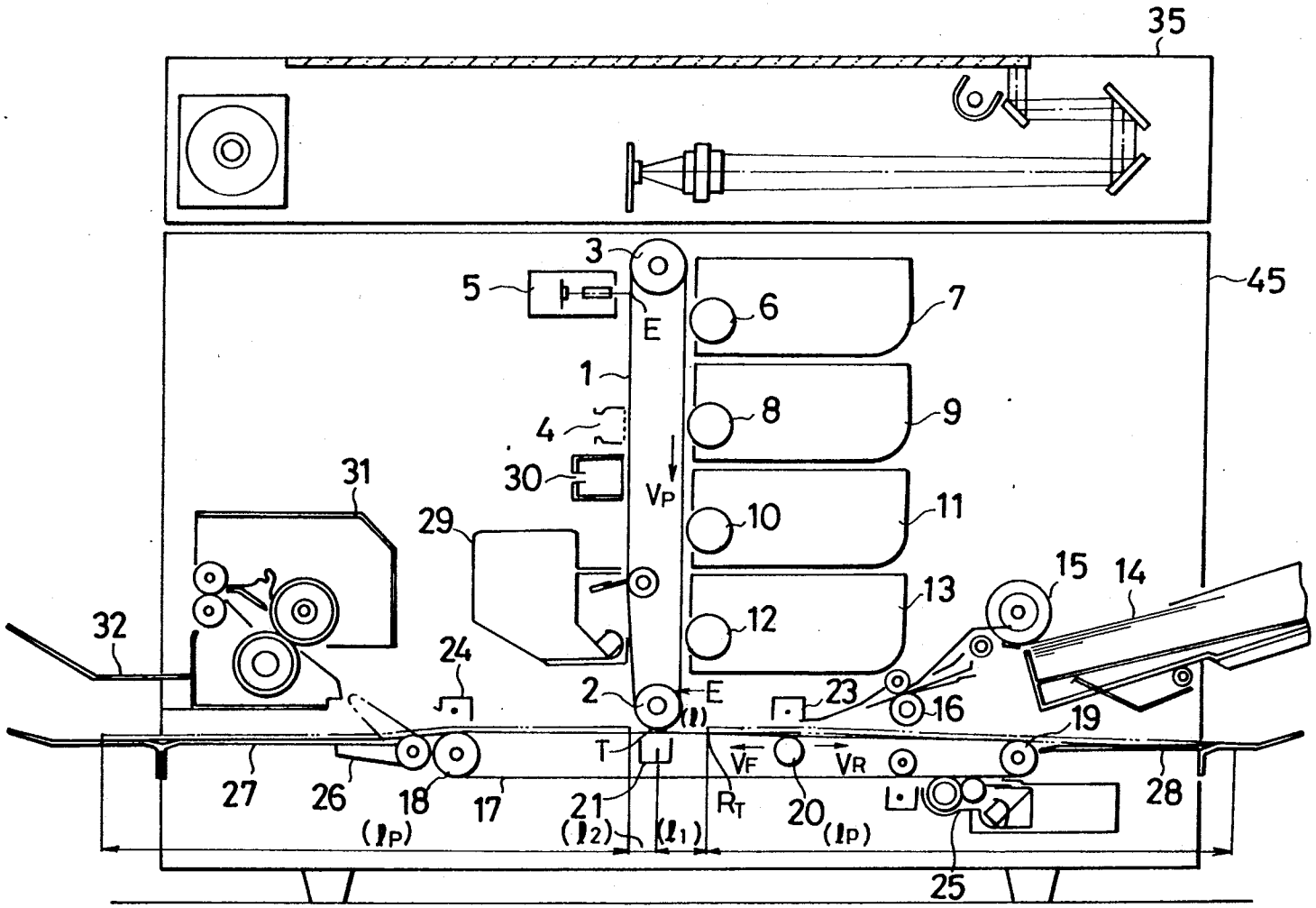

The image forming apparatus in FIG. 15 uses an optical writing means except for a laser beam without an LED array and a liquid crystal shutter array.

In the embodiments shown in FIGS. 12 to 15, a lag time in the writing start is corrected so that a preferably image having no shift in color is formed. For example, when the optical writing means except for the laser beam is used and a write timing pulse is formed on one main scanning line by an internal clock in a driver, etc., this write timing pulse corresponds to the output signal of the synchronization detecting plate in the above-mentioned embodiments.

In the embodiments shown in FIGS. 10 to 15, the correcting circuit uses updown counters composed of four bits, but the present invention is not limited to such a construction. Accordingly, external interruption can be performed by the operation of a central processign unit and an internal counter can be used.

As mentioned above, in accordance with the present invention, the difference between a time point of a command for starting each optical writing operation on a photosensitive body face and a time point of the actual writing operation performed by detecting a subsequently outputted signal on the main scanning line is added to a start time of the transfer conveying belt so as to control the writing start operation. Accordingly, it is possible to prevent reduction of the quality of an image caused by the shift in color. Further, a pulse corresponding to a driving speed of a means for driving the photosensitive body is set to a control signal in the sequential operation of the image forming apparatus. Thus, the shift in color can be prevented even when the moving speed of the photosensitive body is changed. Further, resolution of the above control signal can be suitably set.

Further, the cost of the image forming apparatus can be reduced by using an encoder for a drive motor as a means for generating a pulse in accordance with a driving speed of the drive motor.

Figure 16:
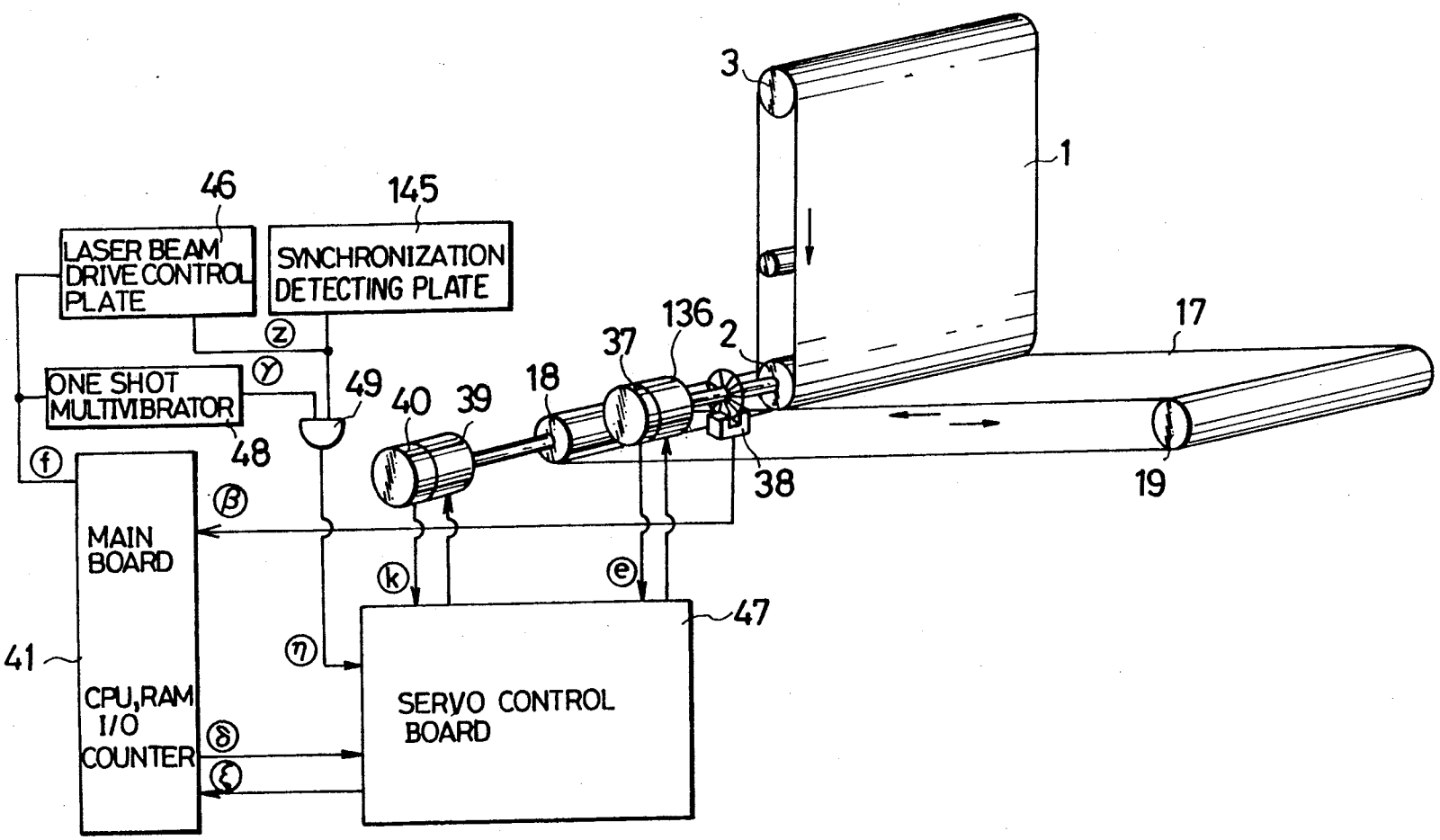
FIG. 16 is a view for explaining a drive control section in an image forming apparatus in a seventh embodiment of the present invention.

FIG. 16 is a view for explaining a drive control section in an image forming apparatus in a seventh embodiment of the present invention. In this figure, reference numerals 1, 17, 41 and 47 respectively designate a photosensitive body belt, a transfer belt, a main board and a servo control board. The other constructions are similar to those in FIG. 1.

As shown in FIG. 16, the photosensitive body belt 1 is movably disposed between a drive roller 2 and a driven roller 3 and is wound around the drive roller 2 and the driven roller 3. A transfer drum 17 is movably disposed between a drive roller 18 and a driven roller 19 in a direction perpendicular to the photosensitive body belt 1. The transfer drum 17 is wound around the drive roller 18 and the driven roller 19.

A PC drive motor 136 for driving the drive roller 2 is connected onto a shaft of the drive roller 2. An encoder 37 is attached to the PC drive motor 136 and an encoder 38 for a PC drive shaft is attached onto a shaft of the drive roller 2. A detecting signal of this encoder 38 for the PC drive shaft is inputted to a main board 41. A detecting signal of the encoder 37 is inputted to a servo control board 47. A control signal is inputted from the servo control board 47 to the PC drive motor 136.

A transfer drive motor 39 is connected onto a shaft of the drive roller 18 and an encoder 40 is attached to the transfer drive motor 39. A detecting signal of the encoder 40 is inputted to the servo control board 47. A control signal from the servo control board 47 is inputted to the transfer drive motor 39.

The main board 41 is electrically connected to the servo control board 47. The main board 41 is also electrically connected to a one-shot multivibrator 48 and a laser beam drive control plate 46. A synchronization detecting plate 145 is connected to the laser beam drive control plate 46 and one input terminal of an aND circuit 49. An output terminal of the one-shot multivibrator 48 is connected to the other input terminal of the AND circuit 49. An output terminal of the AND circuit 49 is connected to the servo control board 47.

The operation of the above-mentioned image forming apparatus in the seventh embodiment of the present invention will next be described with reference to FIGS. 6*a*, 6*b* and 17.

Figure 17:
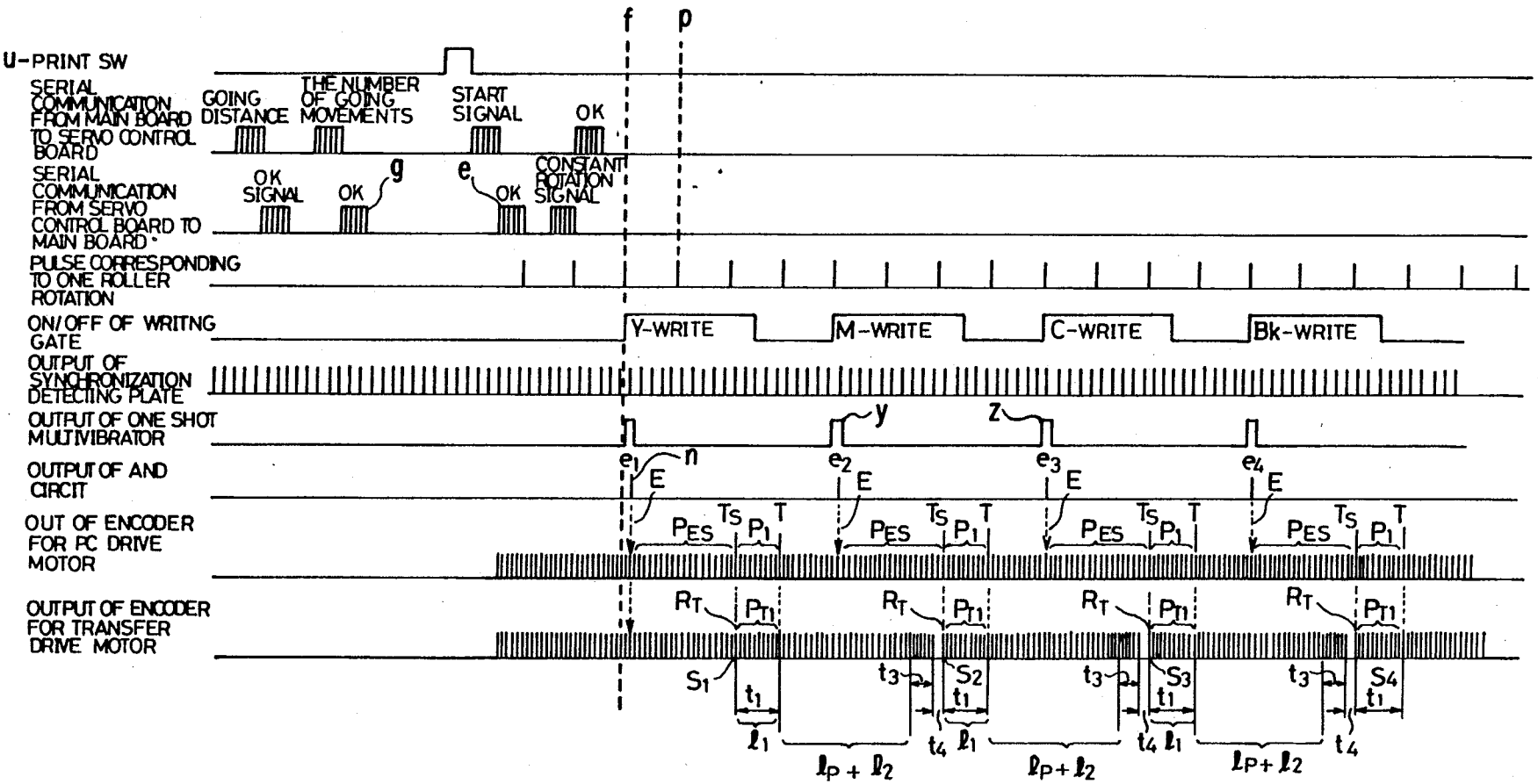
FIG. 17 is a view of signal waveforms showing the operation of a main section in the image forming apparatus in the seventh embodiment of the present invention.

FIG. 17 is a view of signal waveforms showing the operation of a main section in the image forming apparatus in the seventh embodiment of the present invention.

As shown in FIG. 16, bi-directional serial communication can be performed between the main board 41 and the servo control board 47. Accordingly, the main board 41 transmits a going distance signal capable of being judged from the size of a sheet of transfer paper to the servo control board 47. When the servo control board 47 receives this going distance signal, the servo control board 47 transmits an OK signal indicative of the reception of this signal to the main board 41 as shown by item ($\delta$) and ($\epsilon$) in FIG. 17. Next, a signal indicative of the number of going movements estimated from the number of copies and a color mode is transmitted from the main board 41 to the servo control board 47. When the servor control board 47 receives this signal indicative of the number of going movements, the servo control board 47 transmits an OK signal to the main board 41.

When a printer switch is turned on as shown by item (a) in FIG. 6a and item (u) in FIG. 17, a start signal is transmitted from the main board 41 to the servo control board 47. The OK signal is transmitted to the main board 41 from the servo control board 47 receiving this start signal. Further, a control signal for rotating the PC drive motor 136 and the transfer motor 39 in the normal direction is outputted as shown by items (b) and (h) in FIG. 6a.

When line speeds of the PC drive motor 136 and the transfer drive motor 39 has respectively reached $V_P$ and $V_F$, a signal indicative of a constant rotation is transmitted from the servo control board 47 to the amin board 41. The main board 41 receiving this signal indicative of a constant rotation transmits the OK signal to the servo control board 47 as shown by items (δ) and (ε) in FIG. 17.

After the main board 41 has received the signal indicative of a constant rotation, the main board 41 turns on a yellow writing gate in synchronization with a pulse corresponding to one roller rotation as shown by items (f) and (η) in FIG. 17. The one-shot multivibrator 48 generates a pulse having one synchronization detecting period in syncrhonization with a rise of a signal of this writing gate as shown by items (f) and (γ) in FIG. 17. As shown by items (γ) and (z) in FIG. 17, this pulse signal and an output signal of the synchronization detecting plate 145 are inputted to the AND circuit 49. As shown by item (η) in FIG. 17, a timing pulse $e_1$ in the actual yellow writing operation is outputted from the AND circuit 49.

The servo control board 47 counts the number of output signals from the encoder 37 from a time point at which the timing pulse $e_1$ is outputted. A counting value indicative of the number of pulse signals from the encoder 40 for the transfer drive motor 39 is set to zero and is stored to a memory at a time point of a signal $S_1$ at which the counted value of output signals of the encoder 37 has reached a value $P_{ES}$ as shown by item (e) in FIG. 17 and the photosensitive body belt has reached the point Ts in FIG. 1. This point Ts is set to a point $R_T$ as a returning position.

Thereafter, the speeds and positions of the photosensitive body belt and the transfer belt are controlled such that a condition $P_1 = PT_1$ is formed until the point t after a time $_1$, thereby transferring and conveying the sheet of transfer paper.

The operation of the image forming apparatus in the seventh embodiment of the present invention is similar to that described with reference to FIGS. 6a and 6b. In this case, when a front end of a developed yellow image has reached the point Ts separated from the transfer point T by a predetermined distance, the signal $S_1$ for starting the normal rotation of the transfer drive motor 39 is inputted to the servo control board 47 for the transfer drive motor 39 as shown by item (h) of FIG. 6a.

The transfer belt and the sheet of transfer paper are quickly returned by the reverse rotation of the transfer drive motor at a speed VR (>VF) in the direction of a right-hand arrow. At this time, the positions of the transfer belt and the sheet of transfer paper are controlled and returned in the right-hand direction for a short returning time $t_3$ by a distance equal to the distance moved in the left-hand direction for time $t_1+t_3$. A counting operation is then performed with respect to the number of pulses from the encoder 40 for the transfer drive motor 39 corresponding to a distance $l_1+l_P$ (the size of the sheet of transfer paper)$+l_2$. Thereafter, the position of the transfer belt is quickly returned at the speed VR and the movement of the transfer belt is stopped when the counting value indicative of the number of pulses from the encoder 40 becomes zero stored to the memory as mentioned above.

Similar to the case of the yellow image with respect to the first color, when a front end of a magenta image has reached the point Ts, the PC drive roller is rotated four times and is further rotated by the number $P_0$ of pulses of the encoder 37 for the PC drive motor from a writing start timing of magenta image data. At this time point, a signal $S_2$ for starting the normal rotation of the transfer drive motor is inputted to the servo control board 47.

In this embodiment, the encoders 37 and 40 has high resolution 20000 pulses per one rotation to control the speeds and positions of the photosensitive body belt and the transfer belt with high accuracy.

As can be seen from FIGS. 7 and 8 showing signal waveforms for performing the writing operation in the general image forming apparatus to clearly explain the effects of the present invention, a gate for starting the writing operation is turned on in synchronization with a fall of the output signal of the encoder for the PC drive shaft. The actual writing position synchronized with the output signal of the synchronization detecting plate is shifted by each of times $t_Y$, $t_M$ from the original writing position to be located. Therefore, for example, a shift in color is caused by the difference $t_Y - t_M$ in time with respect to yellow and magenta images. If the writing system has e.g., 400 dpi, a maximum value of the difference $t_y - t_M$ in time becomes one period of an output of the synchronization detecting plate. Accordingly, the shift 63.5 μm (25.4 mm/400=0.0635 mm) in color is caused at its maximum.

Figure 18:
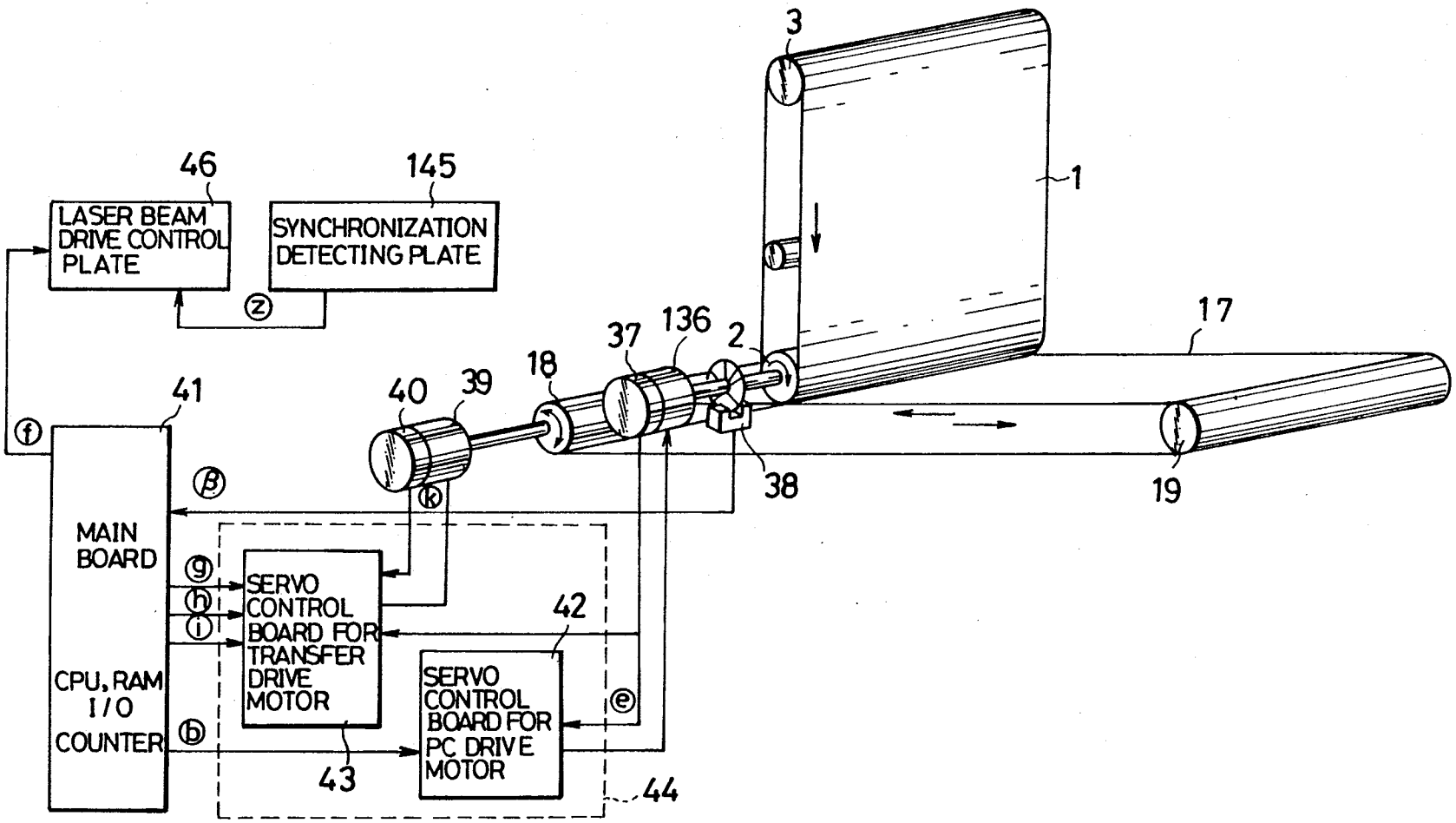
FIG. 18 is a view for explaining a drive control section in a general image forming apparatus.

FIG.18 is a view for explaining a drive control section in the general image forming apparatus for performing the writing operation as shown in FIGS. 7 and 8. In this figure, reference numerals 42, 43 and 44 respectively designate a PC motor servo control board, a transfer motor servo control board and a servo control unit. The same portions as those in FIG. 16 are designated by the same reference numerals. As shown in FIG. 18, an output signal of a synchronization detecting signal 145 is used as a synchronization signal for operating a laser beam drive control plate 46. The writing operation is performed in synchronization with this output signal of the synchronization detecting plate 145 so that the writing operation is delayed as shown in FIGS. 7 and 8.

However, in the seventh embodiment of the present invention, the number of output signals of the encoder 37 for the PC drive motor is counted by the actual writing timing to determine the normal rotation start timing of the transfer drive motor 39. Accordingly, the shift in color can be reduced by one pulse of the encoder 37 for the PC drive motor as shown by the following formula when the diameter of the drive roller is set to 27 mm.

$$(\text{The diameter of the drive roller}) \times \pi/20000\ (\text{PLS}) = 4.24\ (\mu\text{m/PLS}) \quad (2)$$

Figure 19A:
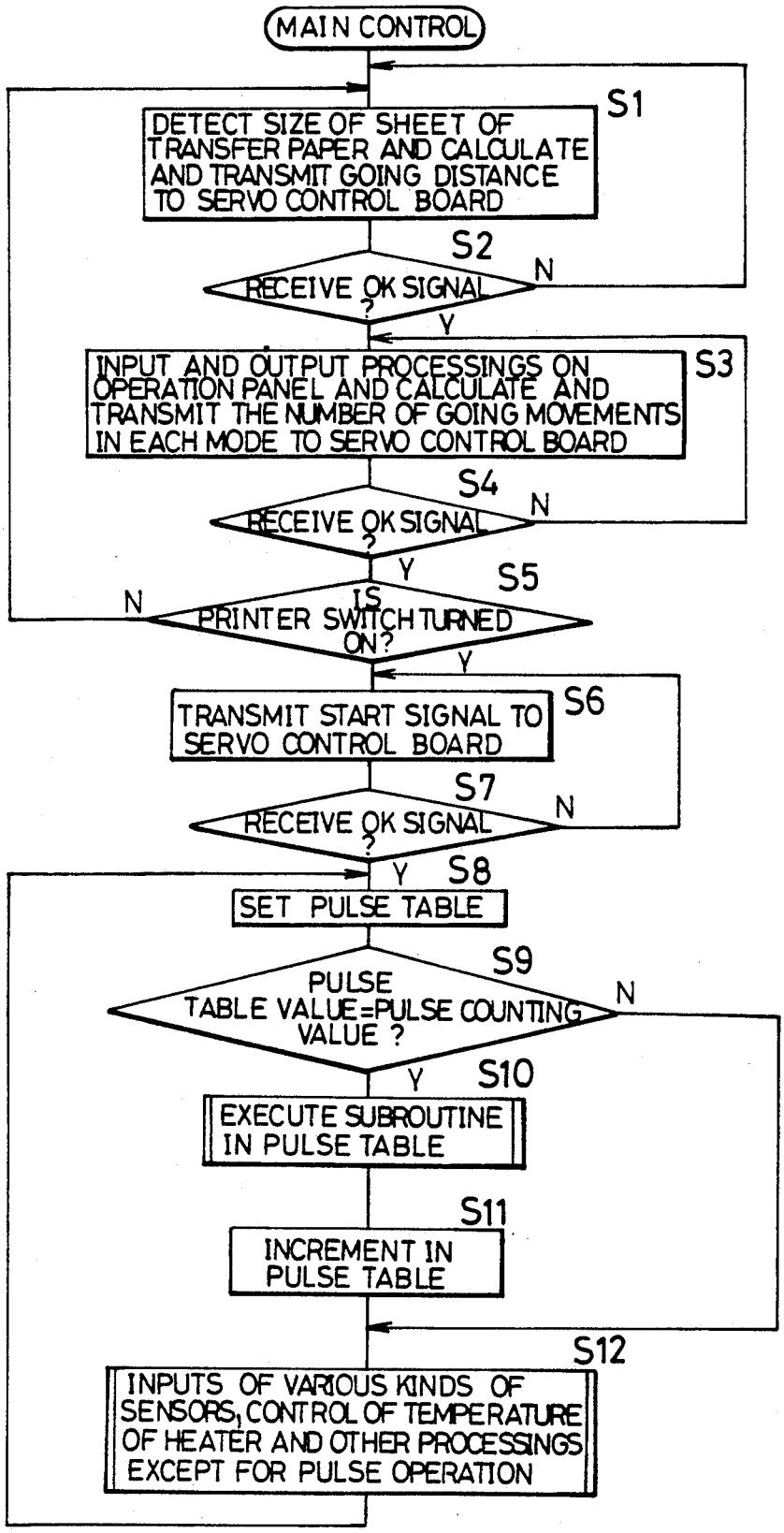
FIG. 19*a* is a flow chart showing the operation of a main board in FIG. 16.
Figure 19B:
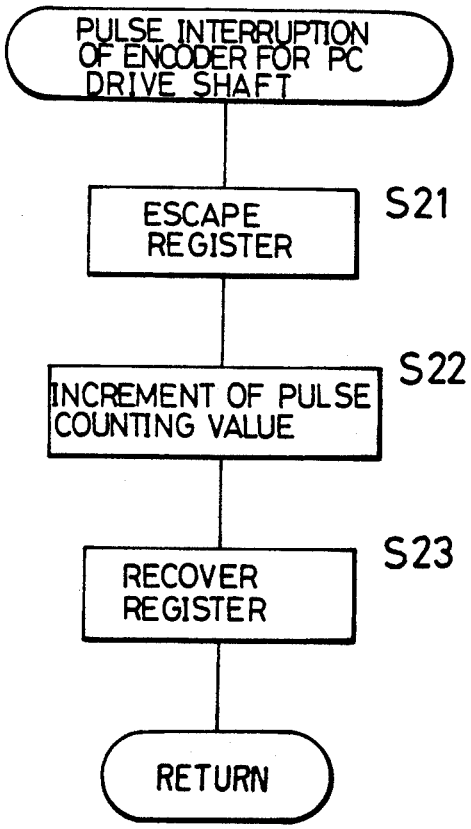
FIG. 19*b* is a flow chart showing a pulse interruption operation of an encoder for a drive shaft.
Figure 19C:
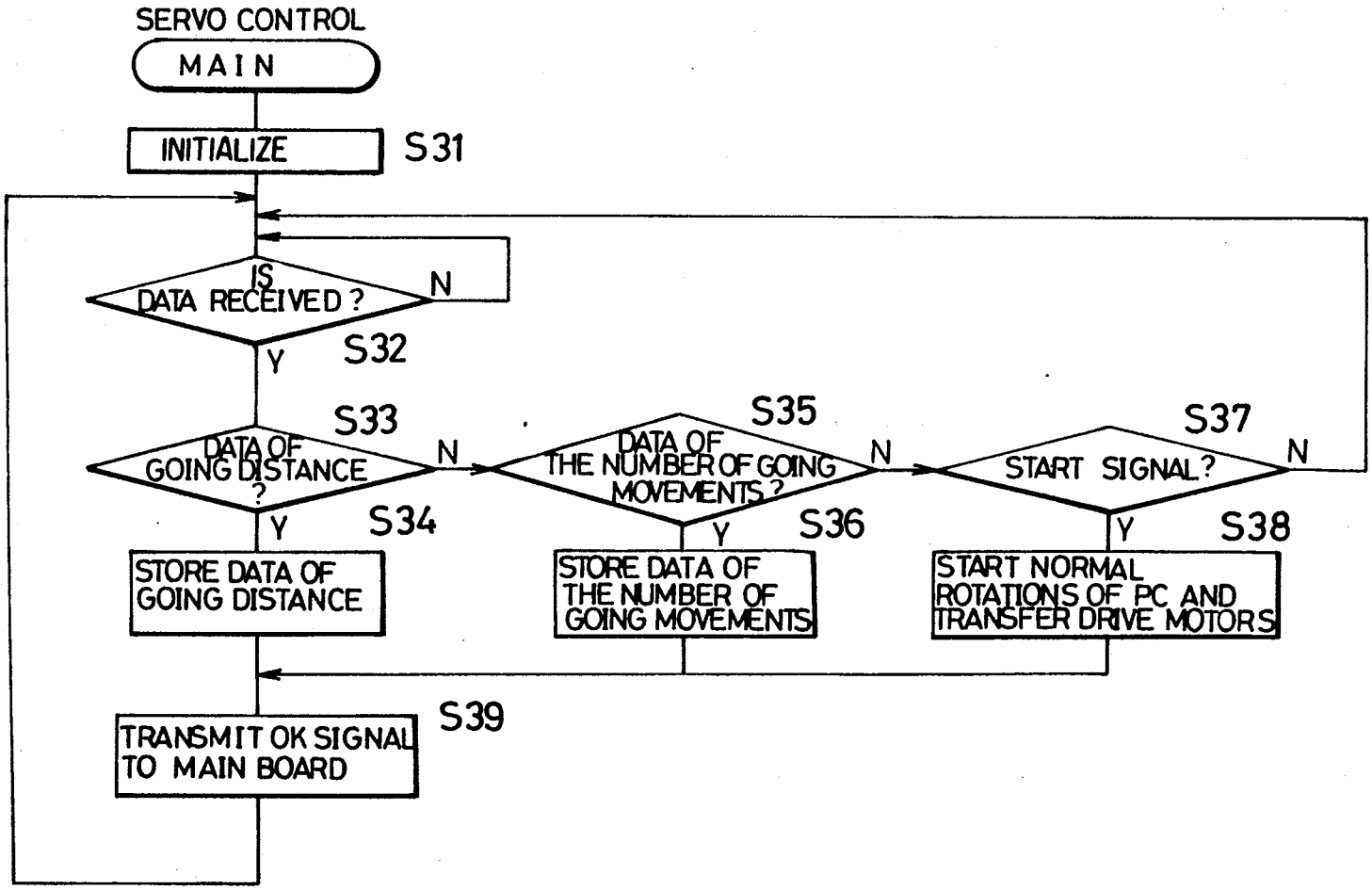
FIG. 19*c* is a flow chart showing the operation of a servo control board in FIG. 16.
Figure 19D:
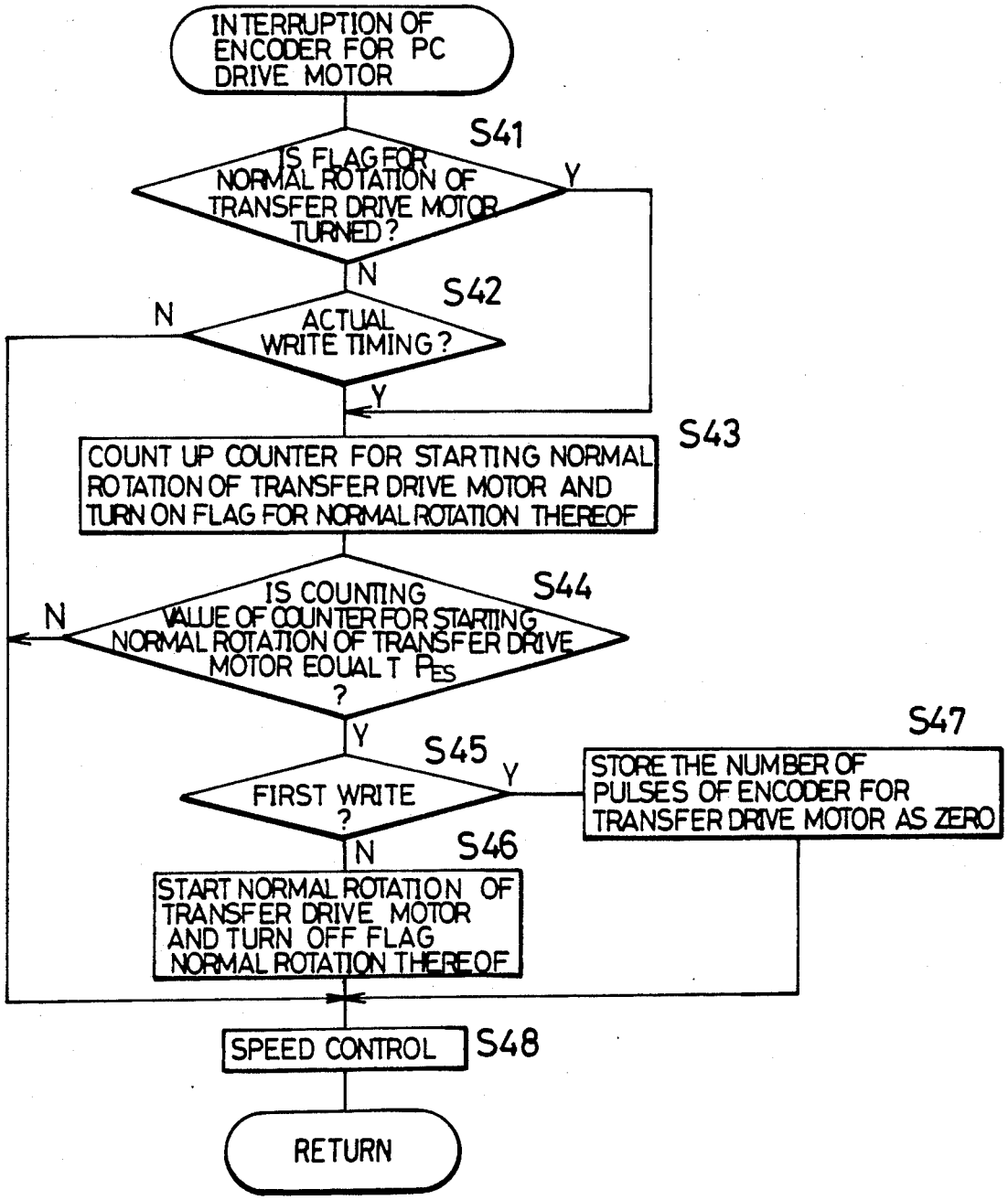
FIG. 19*d* is a flow chart showing an interruption operation of an encoder for a PC drive motor.
Figure 19E:
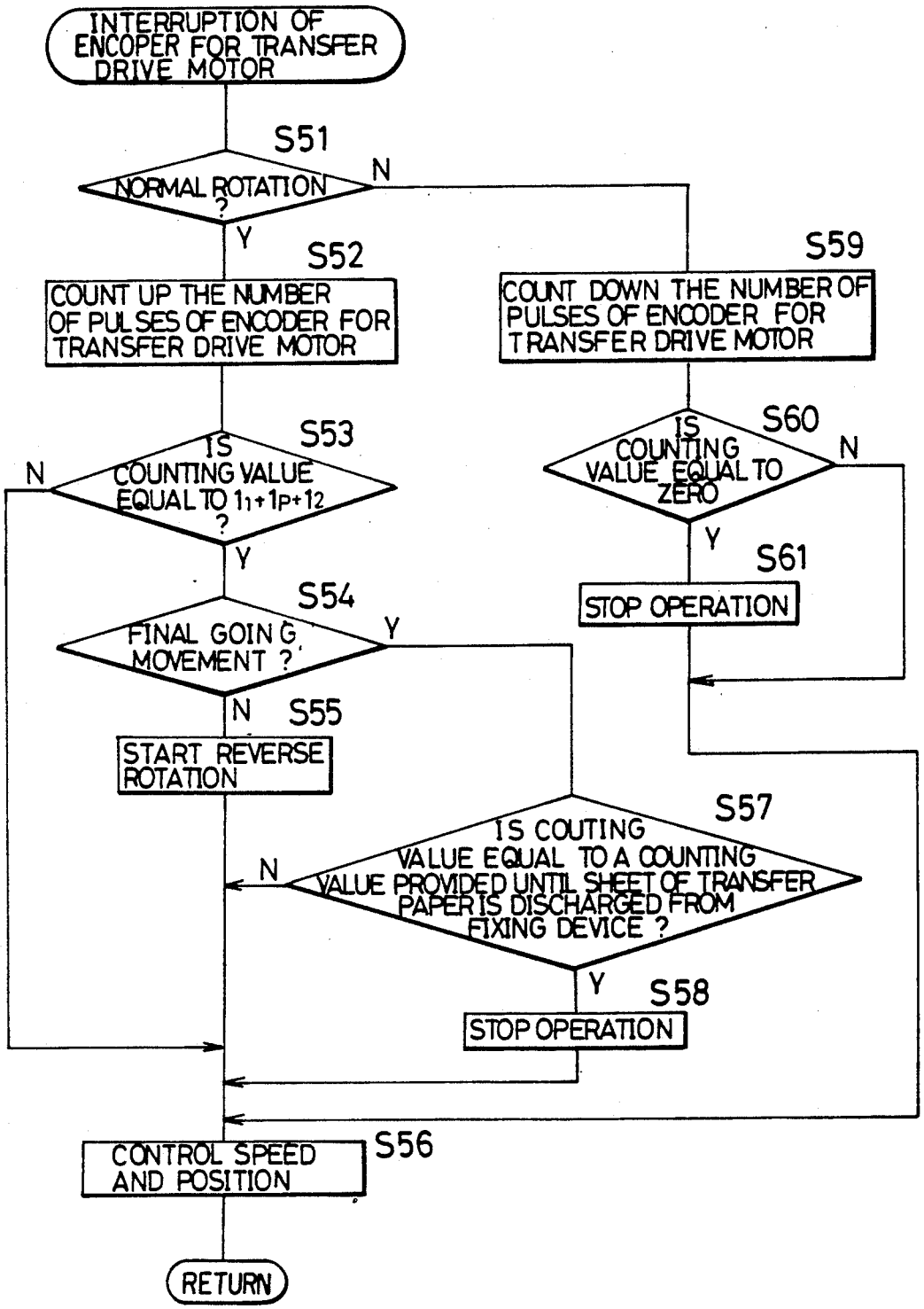
FIG. 19*e* is a flow chart showing an interruption operation of an encoder for a transfer drive motor.

FIG. 19a is a flow chart showing the operation of the main board in the image forming apparatus in the seventh embodiment of the present invention. FIG. 19*b* is a flow chart showing a pulse interruption operation of the encoder for the PC drive shaft. FIG. 19*c* is a flow chart showing the operation of the servo control board in FIG. 16. FIG. 19*d* is a flow chart showing an interruption operation of the encoder for the PC drive motor. FIG. 19*e* is a flow chart showing an interruption operation of the encoder for the transfer drive motor.

In the operation of the main board shown in FIG. 19*a*, the size of a sheet of transfer paper is detected in a step S1. In this step S1, a going distance of the sheet of transfer paper is further calculated and a signal indicative of this going distance is transmitted to the servo control board on the basis of the detection of the size of the sheet of transfer paper. In a step S2, it is judged whether the above OK signal is received or not.

When the OK signal is transmitted from the servo control board 47 and the judgment in the step S2 is YES, input and output processings are performed on an operation panel in a step S3. Further, the number of going movements is calculated from each processing mode and a signal indicative of the number of going movements is transmitted to the servo control board. In a step S4, it is judged whether the OK signal is received or not. When the judgment in the step S4 is YES, it proceeds to a step S5. In the step S5, it is judged whether the printer switch is turned on or not. When this judgment in the step S5 is YES, a start signal is transmitted to the servo control board in a step S6.

It is next judged whether the OK signal is received or not in a step S7. When this judgment in this step S7 is YES, it proceeds to a step S8 in which a pulse table is set. In this pulse table, turning-on and turning-off timings in the signal waveforms shown in FIGS. 7 and 8 are set by the number of pulses.

In a step S9, it is next judged whether or not a value in the pulse table is equal to a pulse counting value. When this judgment in the step S9 is YES, a subroutine for turning on and off each of loads in the pulse table is executed in a step S10 in accordance with each of pulse values. It then proceeds to a step S11 from the step S10 and an incremental operation is performed in the pulse table. Inputting operations with respect to various kinds of sensors, control with respect to temperature of a heater and other processings except for a pulse operation are performed in a step S12. When the judgment in the step S9 is NO, it directly proceeds to the step S12.

In the pulse interruption operation of the encoder for the PC drive shaft shown in FIG. 19*b*, a register is escaped in a step S21. In a step S22, an incremental operation is performed with respect to the counting value indicative of the number of pulses. In a step S23, the operation of the register is recovered.

In the operation of the servo control board shown in FIG.19*c*, the servo control board is initialized in a step S31. In a step S32, it is judged whether or not a data signal is received from the main board. When this judgment in the step S32 is YES, it proceeds to a step S33. In the step S33, it is judged whether a data signal indicative of the going distance is received or not. When the judgment in the step S33 is YES, the data indicative of the going distance are stored to a memory in a step S34.

When the judgment in the step S33 is NO, it proceeds to a step S35. In the step S35, it is judged whether or not the above data are data indicative of the number of going movements. When the judgment in the step S35 is YES, it proceeds to a step S36 in which the data indicative of the number of going movements are stored to the memory.

When the judgment in the step S35 is NO, it proceeds to a step S37. In the step S37, it is judged whether the data signal is a start signal or not. When the judgment in the step S37 is YES, it proceeds to a step S38 in which the normal operations of the PC drive motor 136 and the transfer drive motor 39 are started.

Thus, it proceeds to a step S39 through the steps S34, S36 and S38. In the step S39, the OK signal is transmitted to the main board.

In the flow chart showing the interruption operation of the encoder for the PC drive motor shown in FIG. 19*d*, it is judged in a step S41 whether a flag indicative of the normal rotation of the transfer drive motor is turned on or not. When the judgment in the step S41 is NO, it proceeds to a step S42 in which the actual writing timing is judged. Namely, it is judged in the step S42 whether or not there is an input from the AND circuit 49.

When the judgment in the step S42 is YES, a counter for starting the normal rotation of the transfer drive motor is counted up and the flag indicative of the normal rotation of the transfer drive motor is turned on in a step S43. Next, it is judged in a step S44 whether a counting value of the counter for starting the normal rotation of the transfer drive motor has reached the value $P_{ES}$ or not.

When the judgment in the step S44 is YES, it proceeds to a step S45 for judging a first writing operation. In the step S45, data indicative of the number of overlapped images are included in the data indicative of the number of going movements, thereby judging the first writing operation.

When the judgment in the step S45 is YES, it proceeds to a step S47 in which the number of pulses of the encoder for the transfer drive motor is stored to a memory as value zero. It then proceeds to a step S48 for controlling the speed of the transfer drive motor. When the judgment in the step S45 is NO, it proceeds to a step S46 in which the normal rotation of the transfer drive motor is started and the flag indicative of the normal rotation of the transfer drive motor is turned off. It then proceeds to the step S48 for controlling the speed of the transfer drive motor.

When the judgment in the step S41 is YES, it directly proceeds to the step S43. When the judgments in the steps S42 and S44 are NO, it directly proceeds to the step S48.

In the interruption operation of the encoder for the transfer drive motor shown in FIG. 19*e*, it is judged in a step S51 whether the transfer drive motor is rotated in the normal direction or not. When this judgment in the step S51 is YES, it proceeds to a step S52 for counting up the number of pulses of the encoder for the transfer drive motor. It then proceeds to a step S53 for judging whether or not this counting value has reached a value $l_1+l_P+l_2$.

When the judgment in the step S53 is YES, it proceeds to a step S54 for judging a final going movement. When the judgment in the step S54 is NO, it proceeds to a step S55 for starting the reverse rotation of the transfer drive motor. It then proceeds to a step S56 for controlling the speed and position of the transfer drive motor. When the judgment in the step S53 is NO, it directly proceeds to the step S56.

When the judgment in the step S54 is YES, it proceeds to a step S57 for judging whether or not the above counting value is a counting value provided until the sheet of transfer paper is discharged from the fixing device 31 shown in FIG. 1. When the judgment in the step S57 is YES, it proceeds to a step S58 for stopping the rotation of the transfer drive motor. It then proceeds to a step S56. When the judgement in the step S57 is NO, it directly proceeds to the step S56.

When the judgement in the step S51 is NO, it proceeds to a step S59 for counting down the number of pulses of the encoder for the transfer drive motor. It then proceeds to a step S60 for judging whether the counting value is zero or not. When the judgement in the step S60 is YES, it proceeds to a step S61 for stopping the rotation of the transfer drive motor. It then proceeds to the step S56. In contrast to this, when the judgement in the step S60 is NO, it directly proceeds to the step S56.

As mentioned above, in accordance with the seventh embodiment of the present invention, the transfer means is operated and alignment of overlapped images is controlled by using a position as a reference in which a front end of an image written to the photosensitive body in synchronization with the output signal of the synchronization detecting plate 145 is moved by a predetermined distance. Accordingly, it is possible to prevent the quality of an image from being reduced by a shift in color.

Further, no shift in color is caused even when the moving speed of the photosensitive body belt 1 is changed since the transfer control with respect to overlapped images is performed in a position in which the photosensitive body belt is removed by a predetermined distance from the writing timing.

Further, a command control line between the servo control board and the main board 41 for performing the sequential operation is composed of only a serial communication line and one line synchronization detecting output line.

Therefore, the number of input and output interfaces for response at a high speed between both the boards is reduced so that the load of a central processing unit for each control is reduced and reliability is improved.

As mentioned above, in accordance with the seventh embodiment of the present invention, the transfer means for sequentially overlapping and transferring a plurality of images onto a transferred member is operated by using a position as a reference in which the front end of an image written to the photosensitive body of an image written to the photosensitive body by the writing means is moved by a predetermined distance. In accordance with such a simplified structure, it is possible to form a transferred image having a high quality and no shift in color.

Many widely different embodiments of the present invention may be constructed without departing from the spirit and scope of the present invention. It should be understood that the present invention is not limited to the specific embodiments described in the specification, except as defined in the appended claims.

What is claimed is:

1. A color image forming apparatus comprising:

a supporting body for supporting a latent image;

a first driving means for driving said supporting body;

a latent image forming means for writing digitally the latent image every one line onto said supporting means, a driving of said latent image forming means being controlled in asynchronism with that of said first driving means;

a developing means for developing the latent image formed on said supporting means by said latent image forming means to a visible image;

a second driving means for driving a medium onto which the visible image developed by said developing means is transferred, a starting and driving of said second driving means being controlled in synchronism with that of said first driving means;

an indicating means for indicating the writing of the latent image by said latent image forming means, wherein said indication occurs in synchronism with the driving of said first driving means;

a detecting means for detecting any time lag from the indication of writing by said indicating means to the substantial start of writing of the latent image, by said latent image forming means; and means for delaying a starting of the driving of said second driving means in response to any detected time lag, by said detecting means.

2. A color image forming apparatus according to claim 1, in which said latent image forming means forms a plurality of latent images in time series, said developing means developes the latent images by toners with different colors, the respective visible images are overlapped on said supporting body to thereby form color images.

3. A color image forming apparatus according to claim 2, in which said detecting means detects the time lag in forming each of a plurality of the latent images.

4. A color image forming apparatus according to claim 1, in which said color image forming apparatus further comprises a pulse generating means for generating a pulse output in accordance with a driving speed of said first driving means.

5. A color image forming apparatus according to claim 4, in which said pulse generating means comprises an encoder disposed in a drive transmission system including a driving shaft for said supporting body.

* * * * *